US009335719B2

(12) United States Patent
Ogino

(10) Patent No.: US 9,335,719 B2
(45) Date of Patent: May 10, 2016

(54) INTERVAL SECURING MEMBER, DEVELOPING APPARATUS, AND PROCESS CARTRIDGE

(71) Applicant: CANON KABUSHIKI KAISHA, Tokyo (JP)

(72) Inventor: Hiroki Ogino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/704,810

(22) Filed: May 5, 2015

(65) Prior Publication Data

US 2015/0234346 A1 Aug. 20, 2015

Related U.S. Application Data

(63) Continuation of application No. 14/253,769, filed on Apr. 15, 2014, now Pat. No. 9,042,775.

(30) Foreign Application Priority Data

Apr. 23, 2013 (JP) ..... 2013-090804

(51) Int. Cl.
*G03G 21/16* (2006.01)
*G03G 21/18* (2006.01)

(52) U.S. Cl.
CPC ..... *G03G 21/1647* (2013.01); *G03G 21/18* (2013.01)

(58) Field of Classification Search
CPC ..... G03G 21/18; G03G 21/1814; G03G 5/47
USPC ..... 399/111
See application file for complete search history.

(56) References Cited

PUBLICATIONS

Machine translation of Numagami JP 2003-186303 A, publication date: Jul. 4, 2003.*

* cited by examiner

*Primary Examiner* — Walter L Lindsay, Jr.
*Assistant Examiner* — Frederick Wenderoth
(74) *Attorney, Agent, or Firm* — Canon U.S.A., Inc., IP Division

(57) ABSTRACT

An interval securing member configured to maintain a distance between an image bearing member and a developer bearing member includes a first image bearing member side contact portion that contacts with the image bearing member upstream in a rotation direction of the image bearing member from a nearest position where the distance between the image bearing member and the developer bearing member becomes the smallest, a first developing side contact portion that contacts with the developer bearing member upstream from the nearest position in a rotation direction of the developer bearing member, a second image bearing member side contact portion that contacts with the image bearing member downstream from the nearest position in the rotation direction of the image bearing member, and a second developing side contact portion that contacts with the developer bearing member downstream from the nearest position in the rotation direction of the developer bearing member.

39 Claims, 18 Drawing Sheets

INTERVAL SECURING MEMBER, DEVELOPING APPARATUS, AND PROCESS CARTRIDGE

CROSS-REFERENCE TO RELATED APPLICATIONS

This application is a continuation of U.S. patent application Ser. No. 14/253,769 filed Apr. 15, 2014, which claims the benefit of Japanese Patent Application No. 2013-090804, filed in Apr. 23, 2013, all of which are hereby incorporated by reference herein in their entirety.

BACKGROUND OF THE INVENTION

1. Field of the Invention

This disclosure relates to an interval securing member to be used for an image forming apparatus, and a developing apparatus and a process cartridge having the interval securing member.

The term "image forming apparatus" used here includes electrophotographic copying machines, electrophotographic printers (for example, laser beam printers, LED printers, and the like), and facsimile apparatuses configured to form images on recording media using, for example, an electrophotographic image forming system.

2. Description of the Related Art

In the related art, in the image forming apparatus using the electrophotographic image forming process, in order to restrict a distance between a photosensitive drum (an image bearing member) and a developing roller (a developer bearing member) to be constant, an interval securing member referred to as a SD roller is provided at an end of the developing roller (see Japanese Patent Laid-Open No. 8-305106 and Japanese Patent Laid-Open No. 6-230665).

The SD roller is clamped between the photosensitive drum and the developing roller, and restricts the distance between the photosensitive drum and the developing roller to be constant by the thickness of the SD roller.

The photosensitive drum and the developing roller rotates so that peripheral surfaces thereof move in the same direction at opposing portions, and the SD roller maintains an interval between the photosensitive drum and the developing roller while being rotated by the photosensitive drum or the developing roller.

As the developing roller rotates, the portion of the SD roller that comes into contact with the photosensitive drum changes. If the SD roller has a portion which is not uniform in radius, when the portion contacts with the photosensitive drum, the interval between the photosensitive drum and the developing roller varies, and an image may be affected thereby.

Therefore, the dimensions of the SD roller are precisely controlled so as to have a uniform radius over the entire periphery thereof.

The image forming apparatus using the SD roller of the related art satisfies an image quality presently required. However, since higher image quality is required in recent years, the distance between the photosensitive drum and the developing roller needs to be maintained further precisely in the future.

This disclosure provides an interval securing member that has a simple structure and is not moved by rotations of the developer bearing member and the image bearing member in the direction of the rotations during an image-forming period.

Accordingly, this disclosure is provided to maintain the distance between the image bearing member and the developer bearing member stably.

SUMMARY OF THE INVENTION

An aspect of this disclosure is an interval securing member configured to maintain a distance between an image bearing member and a developer bearing member, the image bearing member being provided rotatably and configured so that a latent image is formed thereon, the developer bearing member being configured to bear developer for developing the latent image and rotate so as to cause opposed surfaces thereof and of the image bearing member to move in the same direction. The interval securing member includes a first image bearing member side sliding contact portion configured to come into sliding contact with the image bearing member on an upstream side in a direction of rotation of the image bearing member from a nearest position where the distance between the image bearing member and the developer bearing member becomes the smallest; a first developing side sliding contact portion configured to come into sliding contact with the developer bearing member on an upstream side from the nearest position in a direction of rotation of the developer bearing member; a second image bearing member side sliding contact portion configured to come into sliding contact with the image bearing member on a downstream side from the nearest position in the direction of rotation of the image bearing member; and a second developing side sliding contact portion configured to come into sliding contact with the developer bearing member on a downstream side from the nearest position in the direction of rotation of the developer bearing member, in which the first image bearing member side sliding contact portion and the first developing side sliding contact portion come into abutment with the image bearing member and the developer bearing member respectively, so that the interval securing member is prevented from moving in the direction of rotations of the image bearing member and the developer bearing member when the image bearing member and the developer bearing member rotate.

Another aspect of this disclosure is a developing apparatus used in an image forming apparatus. The developing apparatus includes a developer bearing member configured to bear developer and rotate so as to cause opposed surfaces thereof and of an image bearing member to move in the same direction; and an interval securing member configured to maintain the distance between the image bearing member and the developer bearing member, in which the interval securing member includes a first image bearing member side sliding contact portion configured to come into sliding contact with the image bearing member on an upstream side in a direction of rotation of the image bearing member from a nearest position where the distance between the image bearing member and the developer bearing member becomes the smallest; a first developing side sliding contact portion configured to come into sliding contact with the developer bearing member on an upstream side from the nearest position in a direction of rotation of the developer bearing member; a second image bearing member side sliding contact portion configured to come into sliding contact with the image bearing member on a downstream side from the nearest position in the direction of rotation of the image bearing member; and a second developing side sliding contact portion configured to come into sliding contact with the developer bearing member on a downstream side from the nearest position in the direction of rotation of the developer bearing member, in which the first image bearing member side sliding contact portion and the first developing side sliding contact portion come into abutment with the image bearing member and the developer bearing member respectively, so that the interval securing member is prevented from moving in the direction of rotations of the image bearing member and the developer bearing member when the image bearing member and the developer bearing member rotate.

A third aspect of this disclosure is a process cartridge configured to be detachably attachable to a main body of an image forming apparatus. The process cartridge includes an image bearing member provided rotatably and configured so that a latent image is formed thereon, a developer bearing member configured to bear developer for developing the latent image and rotate so as to cause opposed surfaces thereof and of the image bearing member to move in the same direction, and an interval securing member configured to maintain the distance between the image bearing member and the developer bearing member, in which the interval securing member includes a first image bearing member side sliding contact portion configured to come into sliding contact with the image bearing member on an upstream side in a direction of rotation of the image bearing member from a nearest position where the distance between the image bearing member and the developer bearing member becomes the smallest; a first developing side sliding contact portion configured to come into sliding contact with the developer bearing member on an upstream side from the nearest position in a direction of rotation of the developer bearing member; a second image bearing member side sliding contact portion configured to come into sliding contact with the image bearing member on a downstream side from the nearest position in the direction of rotation of the image bearing member; and a second developing side sliding contact portion configured to come into sliding contact with the developer bearing member on a downstream side from the nearest position in the direction of rotation of the developer bearing member, in which the first image bearing member side sliding contact portion and the first developing side sliding contact portion come into abutment with the image bearing member and the developer bearing member respectively, so that the interval securing member is prevented from moving in the direction of rotations of the image bearing member and the developer bearing member when the image bearing member and the developer bearing member rotate.

Further features of the present invention will become apparent from the following description of exemplary embodiments with reference to the attached drawings.

DESCRIPTION OF THE EMBODIMENTS

Figure 1:
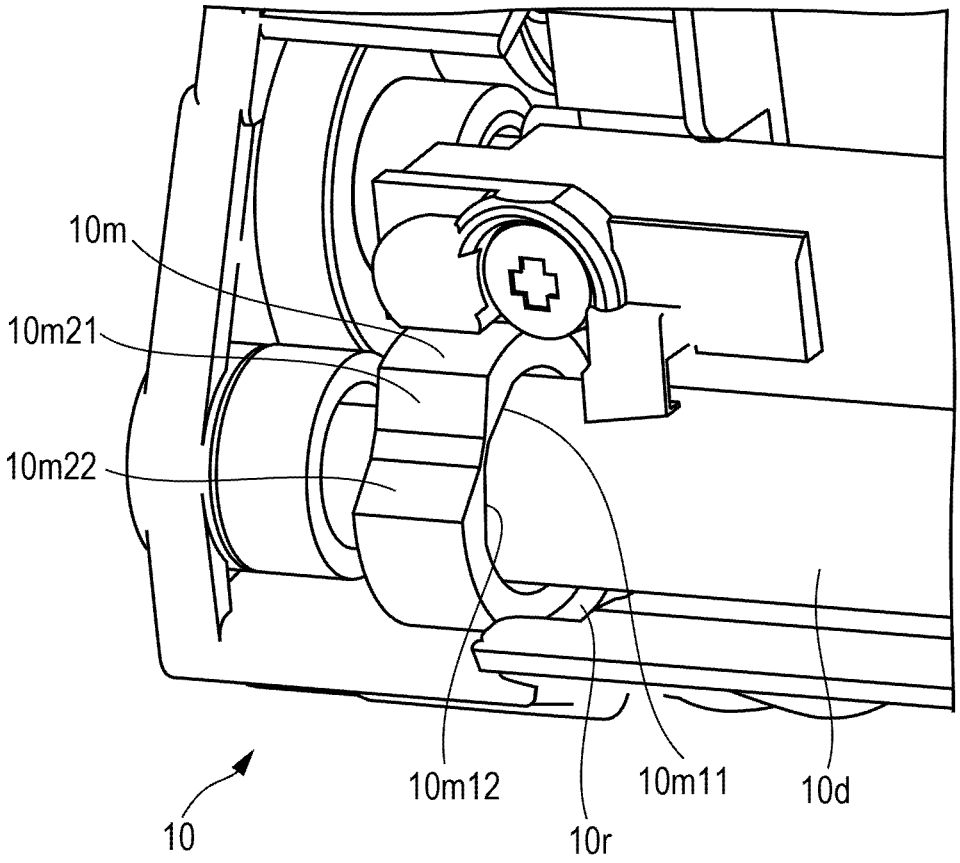
FIG. 1 is an explanatory drawing of a developing apparatus.

Referring to the drawings, preferred embodiments of this disclosure will be described below by examples in detail. However, the scope of this disclosure is not specifically limited to dimensions, materials, and shapes of components, and relative arrangements disclosed in the embodiment unless otherwise specifically limited. The materials and the shapes of members described once in the following description are the same throughout unless otherwise specifically described again.

In the following description, the term "longitudinal direction of the process cartridge" corresponds to an axial direction of the image bearing member (photosensitive drum) that is a direction in which the rotational axis of the image bearing member extends. In other words, the longitudinal direction extends in parallel to a surface of a recording medium, and corresponds to a direction intersecting (substantially orthogonal to) a conveyance direction of the recording medium. The left or right corresponds to the left or the right when viewing the recording medium from above in the conveyance direction. An upper surface of the process cartridge corresponds to the surface positioned on an upper side, and the lower surface is a surface positioned on the lower side when the process cartridge is mounted on the main body of the apparatus.

Example 1

Figure 2:
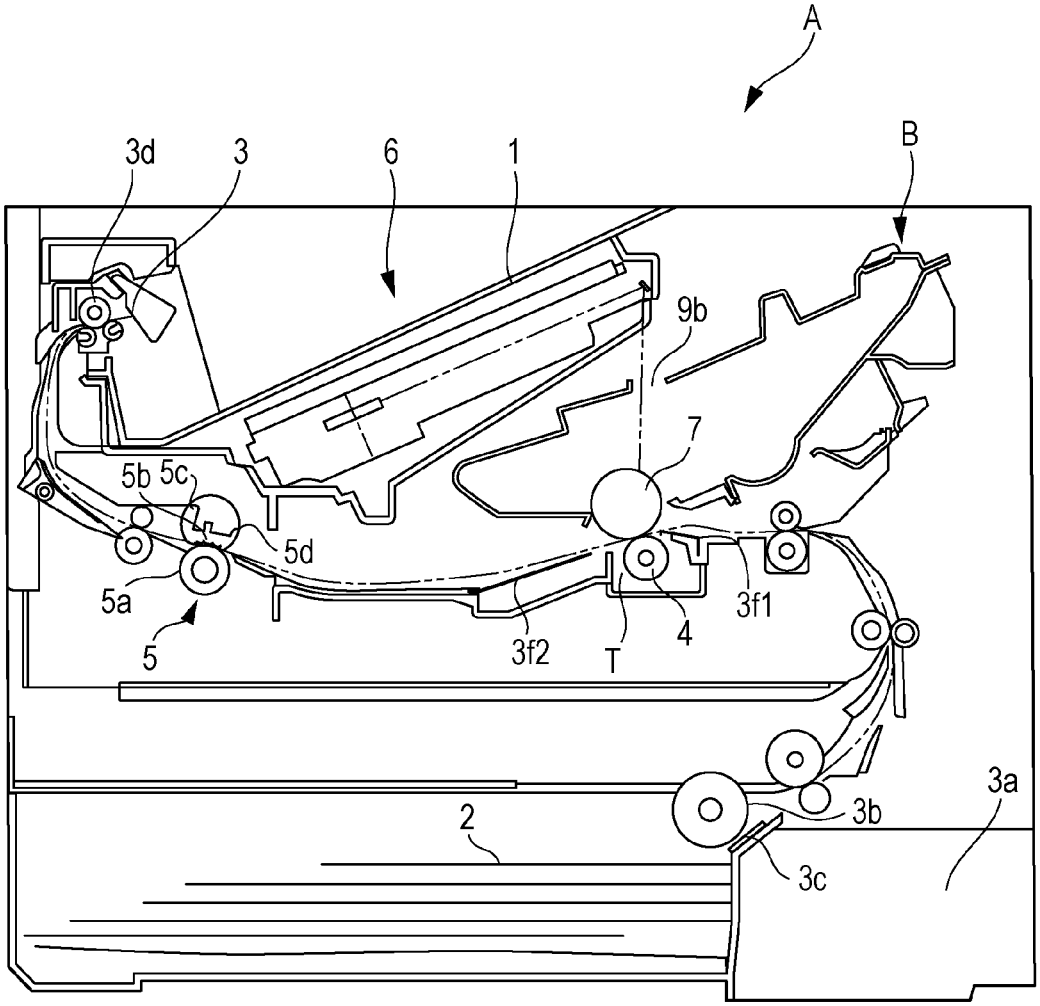
FIG. 2 is an explanatory drawing of an image forming apparatus.

Description of General Configuration of Electrophotographic Image Forming Apparatus First, a general configuration of the electrophotographic image forming apparatus (hereinafter, "image forming apparatus") will be described with reference to FIG. 2. FIG. 2 is a schematic diagram illustrating a cross section of the image forming apparatus in which a process cartridge of the embodiment is mounted and, more specifically, a schematic diagram illustrating a cross section of a laser beam printer that is an embodiment of the image forming apparatus.

As illustrated in FIG. 2, an image forming apparatus (a laser beam printer) A of the embodiment includes a photosensitive drum 7 as the image bearing member. The image forming apparatus A is configured to irradiate the photosensitive drum 7 having a drum shape with information light on the basis of image information from an optical system 1 as an optical unit (an optical device), and form an electrostatic latent image on the photosensitive drum 7. The electrostatic latent image is developed by a developer (hereinafter, referred to as "toner"), and a toner image is formed. Synchronously with the formation of the toner image, a recording medium (for example, recording paper, OHP sheet, fabric or the like) 2 is fed from a cassette 3*a* one by one separately by a pickup roller 3*b* and a press-contact member 3*c* in press contact thereto.

The fed recording medium 2 is conveyed along a conveyance guide 3*f*1 to a transfer portion T where the photosensitive drum 7 of a process cartridge B and a transfer roller 4 as a transfer device oppose each other.

The recording medium 2 conveyed to the transfer portion T. The toner image formed on the photosensitive drum 7 is transferred to the recording medium 2 by the transfer roller 4 having a voltage applied thereto. The recording medium 2 is conveyed to a fixing unit 5 along a conveyance guide **3*f*2**.

The fixing unit 5 includes a drive roller **5*a* and a fixed rotating body 5*d* that includes a heater 5*b* integrated therein. The fixed rotating body 5*d* is composed of a cylindrical sheet which is rotatably supported by a support member 5*c*. The fixing unit 5 fixes the transferred toner image by applying heat and pressure to the passing recording medium 2**.

A discharge roller **3*d* is configured to convey the recording medium 2 having the toner image fixed thereto and discharge the recording medium 2 to a discharge portion 6 through a reversal conveying path. In the embodiment, the pickup roller 3*b*, the press-contact member 3*c*, the discharge roller 3*d*, and the like constitute a conveying device 3**.

Process Cartridge

Figure 3:
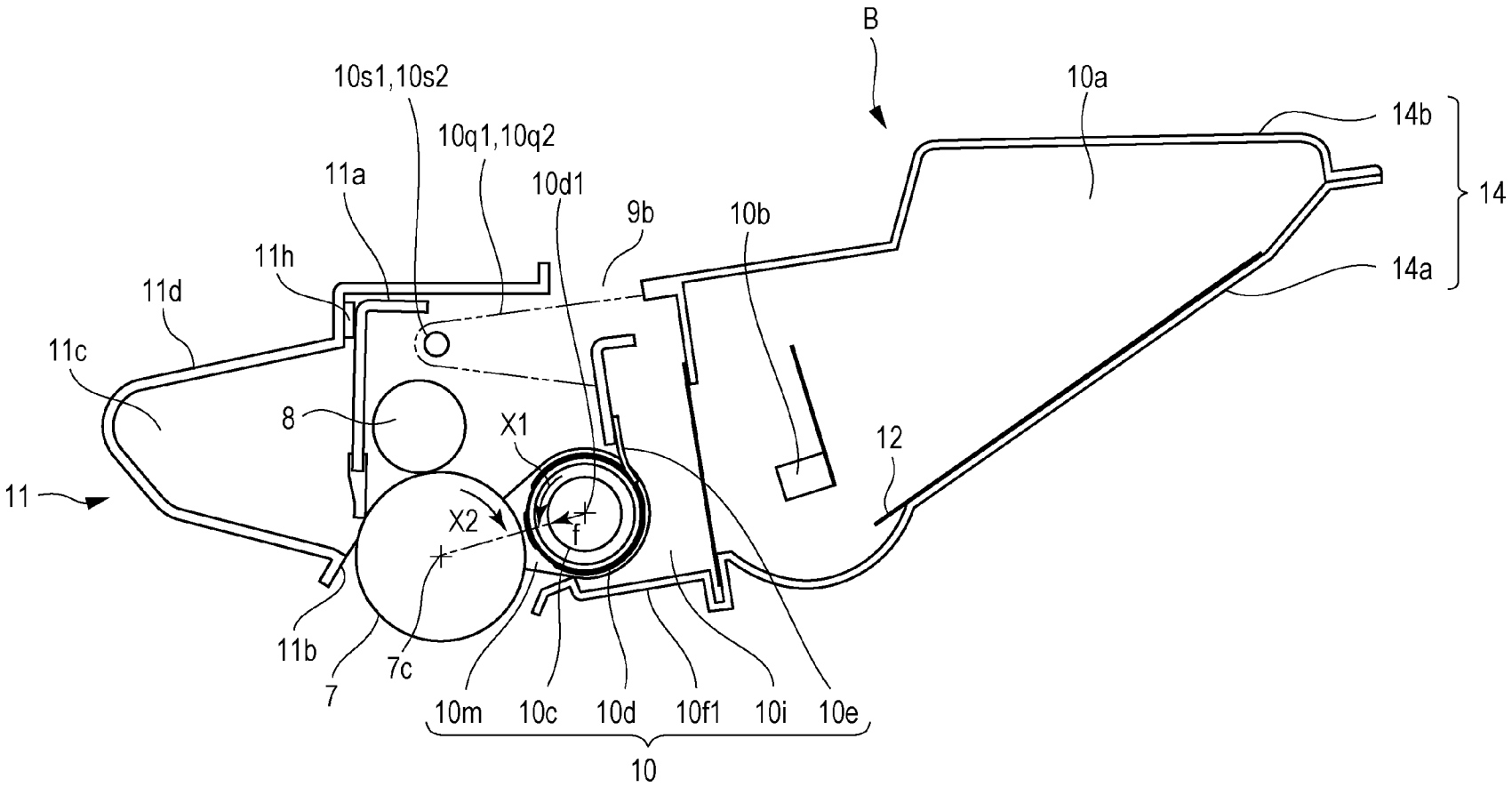
FIG. 3 is an explanatory drawing illustrating a process cartridge.

Subsequently, a general configuration of the process cartridge will be described with reference to FIG. 3. FIG. 3 is a schematic diagram illustrating a cross section of the process cartridge of the embodiment.

As illustrated in FIG. 3, the process cartridge B includes the photosensitive drum and at least one process unit. Examples of the process unit here include, for example, a charging device configured to charge the photosensitive drum, a developing device configured to develop the electrostatic latent image formed on the photosensitive drum, and a cleaning device configured to clean the toner remaining on the photosensitive drum.

The process cartridge B of the embodiment is configured to rotate the photosensitive drum 7 having a photosensitive layer thereon, apply a voltage to a charge roller 8, which corresponds to a charging device, and charge the surface of the photosensitive drum 7 evenly. The charged photosensitive drum 7 is exposed to information light (an optical image) based on image information from the optical system 1 through an exposure aperture **9*b* to form an electrostatic latent image on the surface of the photosensitive drum 7, and the electrostatic latent image is developed by a developing unit 10. The developing unit 10** corresponds to a developing apparatus in this example.

The developing unit 10 accommodates toner in a toner chamber **10*a* which corresponds to a toner accommodation section of a toner frame 14. The developing unit 10 feeds the toner to a developing chamber 10*i* by a rotatable developer conveying member (hereinafter, referred to as "a toner feeding member") 10*b* and a resilient sheet 12 configured to vibrate in a rotating region of the toner feeding member 10*b*** by interfering therewith.

The developing unit 10 rotates a developing roller **10*d*, which is a developing rotating body (developer bearing member) having a fixed magnet 10*c* integrated therein. Along with this rotation, the toner layer having triboelectric charge applied thereto by a developing blade 10*e* is formed on a surface of the developing roller 10*d*, the toner is transferred to the photosensitive drum 7** in accordance with the electrostatic latent image to form a visible toner image.

The toner feeding member **10*b* is illustrated by composite members including a toner feeding rod and a sheet member in FIG. 3. However, the toner feeding member 10*b* is not limited to the configuration in FIG. 3**.

After a voltage having a polarity opposite to that of the toner image has been applied to the transfer roller 4 and the toner image has been transferred to the recording medium 2, residual toner on the photosensitive drum 7 is scraped off by a cleaning blade **11*a*. Further, by the cleaning device configured to scoop the residual toner with a scooping sheet 11*b* and collect the scooped toner to a removed toner container 11*c*, the residual toner on the photosensitive drum 7** is removed.

The process cartridge B of the embodiment includes a drum unit 11 that rotatably supports the photosensitive drum 7 and that includes the cleaning blade **11*a* and a drum frame 11*d* having a charge roller 8 integrated therein. The process cartridge B includes a developing unit 10 having the developing roller 10*d* and a developing frame 10*f*1 having a toner chamber 10*a* integrated therein. The process cartridge B is composed of the drum unit 11 and the developing unit 10. The developing frame 10*f*1 is supported so as to be rotatable with respect to the drum frame 11*d*, so that the developing roller 10*d* is allowed to oppose the photosensitive drum 7 in parallel thereto at a predetermined interval therefrom. Interval securing members (hereinafter, referred to as a spacer) 10*m* configured to maintain an interval between the developing roller 10*d* and the photosensitive drum 7 are arranged at both end portions of the developing roller 10*d* (Although there are two spacers 10*m*, the spacers 10*m*** may be described singularly in the following description for the sake of simplification of the description).

The developing frame **10*f*1 includes arm portions 10*q*1 and 10*q*2 having coupling holes 10*s*1 and 10*s*2 respectively for rotatably supporting the developing unit 10 including the developing roller 10*d* on the drum unit 11 including the cleaning blade 11*a***.

Spacer Configured to Secure Interval Between Developing Roller and Photosensitive Drum Subsequently, a configuration of a spacer **10*m* provided to secure an interval between the developing roller and the photosensitive drum will be described specifically with reference to FIG. 1 and FIG. 4**.

Figure 4:
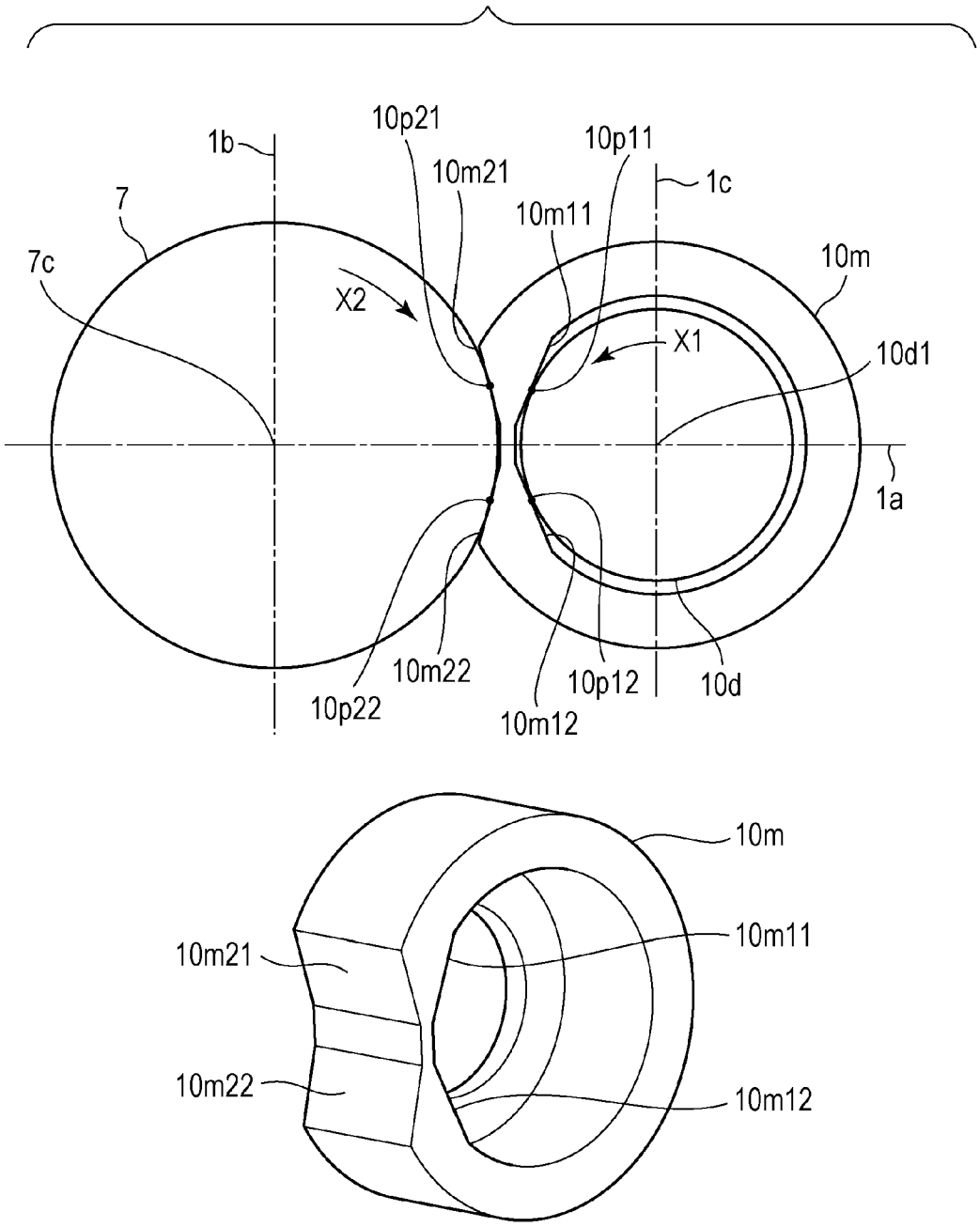
FIG. 4 is an explanatory drawing illustrating a spacer.

As illustrated in FIG. 1 and FIG. 4, the spacer **10*m* includes developing roller contact surfaces 10*m*11 and 10*m*12 extending along peripheral surface of the developing roller 10*d* and photosensitive drum contact surfaces 10*m*21 and 10*m*22 extending along a peripheral surface of the photosensitive drum 7**.

The developing roller contact surfaces **10*m*11 and 10*m*12 and the photosensitive drum contact surfaces 10*m*21 and 10*m*22** are flat surfaces.

The spacers **10*m* are mounted on both end portions of the surface of the developing roller 10*d* in the longitudinal direction as illustrated in FIG. 1. Here, the surface of the developing roller 10*d* on which the spacers 10*m* are mounted may be either a portion on which the toner layer is formed or a portion on which the toner layer is not formed. In this example, the spacers 10*m* are mounted to outside of a region where the toner is borne so as to prevent the spacers 10*m*** from affecting image forming.

The spacer **10*m* have a ring shape, and are mounted on the outer periphery of the developing roller 10*d***.

The surface of the developing roller **10*d* which the spacer 10*m* come into contact with is formed of aluminum. The material of the spacer 10*m*** is desirably selected from polyacetal (POM), polyethersulphone (PES), and polyphenylene sulphide (PPS) in terms of good slidability with respect to aluminum.

The photosensitive drum 7 and the developing roller **10*d* are movable with respect to each other, and the photosensitive drum 7 and the developing roller 10*d* are urged toward each other by an application of a predetermined pressure f between the developing unit 10 and the drum unit 11**.

As illustrated in FIG. 4, the spacer 10*m* is brought into abutment with the surface of the developing roller 10*d* at a developing roller sliding contact portion 10*p*11 of the developing roller contact surface 10*m*11 and at a developing roller sliding contact portion 10*p*12 of the developing roller contact surface 10*m*12 by an application of a pressure f illustrated in FIG. 3. The developing roller sliding contact portion 10*p*11 corresponds to a first developing side sliding contact portion and the developing roller sliding contact portion 10*p*12 corresponds to a second developing side sliding contact portion.

In addition, the spacer 10*m* is brought into abutment with the surface of the photosensitive drum 7 at the photosensitive drum sliding contact portion 10*p*21 of the photosensitive drum contact surface 10*m*21 and at the photosensitive drum sliding contact portion 10*p*22 of the photosensitive drum contact surface 10*m*22. The photosensitive drum sliding contact portion 10*p*21 corresponds to a first image bearing member side sliding contact portion and the photosensitive drum sliding contact portion 10*p*22 corresponds to a second image bearing member side sliding contact portion.

The developing roller 10*d* and the photosensitive drum 7 are held at a constant interval by the respective sliding contact portions described above.

The developing roller sliding contact portions 10*p*11 and 10*p*12 and the photosensitive drum sliding contact portions 10*p*21 and 10*p*22 are provided on both sides with respect to a line 1*a* that connects a center 7*c* of the photosensitive drum 7 and a center 10*d*1 of the developing roller 10*d*.

Here, there is a case where alignment between the photosensitive drum 7 and the developing roller 10*d* is deviated. In such a case, the line 1*a* is defined to be a line connecting the given center 7*c* of the photosensitive drum 7 and the given center 10*d*1 of the developing roller 10*d* within a range in which the spacer 10*m* comes into contact with the photosensitive drum 7 and the developing roller 10*d* in the longitudinal direction of the developing roller 10*d*.

Furthermore, a line passing through the center of the photosensitive drum 7 and perpendicular to the line 1*a* is defined as a line 1*b*, and a line passing through the center of the developing roller 10*d* and perpendicular to the line 1*a* is defined as a line 1*c*. At this time, the respective sliding contact portions (10*p*21, 10*p*22, 10*p*11, and 10*p*12) of the spacer 10*m* are arranged within a range between the line 1*b* and the line 1*c*. In other words, the photosensitive drum 7 comes into contact with the spacer 10*m* at a position on the side of the developing roller 10*d* with respect to the line 1*b* and the contact portions are photosensitive drum sliding contact portions 10*p*21 and 10*p*22.

The developing roller 10*d* comes into contact with the spacer 10*m* at a position on the side of the photosensitive drum 7 with respect to the line 1*c*, and the contact portions are developing roller sliding contact portions 10*p*11 and 10*p*12.

At the time of image forming, the developing roller 10*d* and the photosensitive drum 7 rotate respectively in directions X1 and X2 in which peripheral surfaces thereof at opposing portion (opposing surfaces) rotate in the same direction. The spacer 10*m* comes into sliding contact with the developing roller 10*d* at the first and the second developing roller sliding contact portions 10*p*11 and 10*p*12. The spacer 10*m* comes into sliding contact with the photosensitive drum 7 at the first and the second photosensitive drum sliding contact portions 10*p*21 and 10*p*22, respectively.

At this time, the spacer 10*m* brings the developing roller sliding contact portions 10*p*11 and 10*p*12 into sliding contact with a surface of the developing roller 10*d* extending from a surface on which the toner layer is formed. Therefore, the interval between the photosensitive drum 7 and the developing roller 10*d* is determined with high degree of accuracy by the spacer 10*m*.

Here, the spacer 10*m* is provided with the developing roller sliding contact portion 10*p*11 and the photosensitive drum sliding contact portion 10*p*21. The developing roller sliding contact portion 10*p*11 comes into sliding contact with the developing roller on an upstream side of the line 1*a* that connects the rotation center of the photosensitive drum 7 and the rotation center of the developing roller 10*d* in the direction of rotation X1 of the developing roller 10*d*. In the same manner, the photosensitive drum sliding contact portion 10*p*21 comes into sliding contact with the photosensitive drum 7 on the upstream side of the line 1*a* in the direction of rotation X2 of the photosensitive drum 7.

In other words, an interval between the first photosensitive drum sliding contact portion 10*p*21 and the first developing roller sliding contact portion 10*p*11 is longer than the distance between the photosensitive drum 7 and the developing roller 10*d* at the nearest position. In addition, the photosensitive drum sliding contact portion 10*p*21 and the developing roller sliding contact portion 10*p*11 are both on the upstream side of the nearest portion (the nearest contact position) in the direction of rotation. In this configuration, even though the developing roller 10*d* and the photosensitive drum 7 rotate during the image-forming period, the spacer 10*m* does not rotate. In other words, the first photosensitive drum sliding contact portion 10*p*21 and the first developing roller sliding contact portion 10*p*11 come into contact with the photosensitive drum 7 and the developing roller 10*d* to prevent the spacer 10*m* from moving in the direction of rotation of the developing roller 10*d* and the photosensitive drum 7.

The spacer 10*m* is provided with the developing roller sliding contact portion 10*p*12 and the photosensitive drum sliding contact portion 10*p*22 to achieve the sliding contact on the downstream side of the line 1*a* that connects the rotation center of the photosensitive drum 7 and the rotation center of the developing roller 10*d* in the directions X1 and X2.

Therefore, the spacer 10*m* comes into sliding contact with the developing roller 10*d* and the photosensitive drum 7 at the developing roller sliding contact portions 10*p*11 and 10*p*12 and the photosensitive drum sliding contact portions 10*p*21 and 10*p*22, respectively during the image-forming period. Accordingly, even though the developing roller 10*d* and the photosensitive drum 7 rotate, the spacer 10*m* does not rotate. The spacer 10*m* comes into contact with the developing roller 10*d* or the photosensitive drum 7 always at the same portion. Therefore, the interval between the developing roller 10*d* and the photosensitive drum 7 is not changed by the rotation of the developing roller 10*d* and the photosensitive drum 7. The spacer 10*m* is capable of maintaining the interval stably between the developing roller 10*d* and the photosensitive drum 7. Since the image forming apparatus of this example employs a noncontact developing system, the spacer 10*m* secures a state of maintaining a constant interval between the surface of the developing roller 10*d* and the surface of the photosensitive drum 7.

In this example, the spacer 10*m* is configured to keep a clearance with respect to the developing roller 10*d* and the photosensitive drum 7 on a straight line (on the line 1*a*) that connects an axis (a rotational axis) of the developing roller 10*d* and a rotation axis of the photosensitive drum 7. In other words, the spacer 10*m* is configured not to come into contact with the developing roller 10*d* and the photosensitive drum 7 at the nearest position between the developing roller 10*d* and the photosensitive drum 7. Accordingly, a frictional force that the spacer 10*m* receives from the developing roller 10*d* or the photosensitive drum 7 is reduced. Therefore, the spacer 10*m* is reliably prevented from moving in the direction of rotations of the developing roller 10*d* and the photosensitive drum 7 when the developing roller 10*d* and the photosensitive drum 7 rotate.

As described above, it is desirable that the spacer 10*m* does not come into contact with the developing roller 10*d* and the photosensitive drum 7 at the nearest position. However, the configuration is not specifically limited thereto. When the spacer 10*m* comes into contact with the developing roller 10*d* or the photosensitive drum 7 at the nearest position, a configuration which reduces the frictional forces that the spacer 10*m* receives from the developing roller 10*d* or the photosensitive drum 7 at the nearest position is desirably employed. It is for restricting the spacer 10*m* from moving in the direction of rotation of, for example, the developing roller 10*d*.

The process cartridge explained in the embodiment described above has a configuration to form a monochrome image. However, a process cartridge having a plurality of developing devices (developing apparatuses) and configured to form images having a plurality of colors (for example, two-color images, three-color images, or full-color images) is also applicable.

An electrophotographic photosensitive member is not limited to the photosensitive drum and includes, for example, following members. First, a photoconductor is used as the photosensitive member, and the photoconductor includes, for example, amorphous silicon, amorphous selenium, zinc oxide, titanium oxide, and organic photoconductor (OPC).

Examples of the shape of a member on which the photosensitive member is mounted include a drum shape and a belt shape, for example. For example, the drum-shaped photosensitive member is achieved by depositing or coating the photoconductor on a cylinder formed of aluminum alloy or the like.

In the configuration of a charging device, a so-called contact charging method is employed in the embodiment described above. However, other configurations may also be employed. As other configurations, for example, a tungsten wire provided with a metallic shield formed of aluminum or the like in the periphery thereof in three directions is also applicable. The charging device described above moves positive or negative ions generated by applying a high voltage to the tungsten wire to the surface of the photosensitive drum, and charges the surface of the drum uniformly.

The charging device may be a blade (a charging blade), a pad type, a block type, a rod type, a wire type instead of the roller type as described above.

As a cleaning method of toner remaining on the photosensitive drum, a cleaning device may be configured by using a blade, a far brush, a magnetic blush, or the like.

In the example described above, the developing unit (developing apparatus) 10 on which the spacer 10*m* is provided is configured to be detachably attachable to a main body of the image forming apparatus as part of the process cartridge. In other words, the developing roller 10*d*, the photosensitive drum 7, and the spacer 10*m* are detachably attachable on the main body of the image forming apparatus as part of the same process cartridge.

The process cartridge here means a member including at least the developing device and the electrophotographic photosensitive member integrated into a cartridge and being detachably attachable to the image forming apparatus. The process cartridge may be detachably attached to the main body of the apparatus by a user. Therefore, maintenance of the main body of the apparatus may be performed by a user.

However, this disclosure is not limited to this configuration. For example, a plurality of cartridges are detachably attachable to the main body of the image forming apparatus, and a configuration may be employed in which a developing roller 10*d* on which the spacer 10*m* is mounted and the photosensitive drum 7 are detachably attachable to the main body of the image forming apparatus, as separate cartridges. Alternatively, a configuration in which the developing roller 10*d* and the photosensitive drum 7 are included the image forming apparatus and the user does not replace these members is also applicable.

Furthermore, in the above-described embodiment, although the laser beam printer is exemplified as the electrophotographic image forming apparatus, the present disclosure is not limited thereto. For example, this disclosure may also be applied to the electrophotographic image forming apparatuses such as electrophotographic copying machines, electrophotographic printers such as LED printers, facsimile apparatuses, word processors, or copying machines including these apparatuses (multifunction printers and the like).

Example 2

Figure 15:
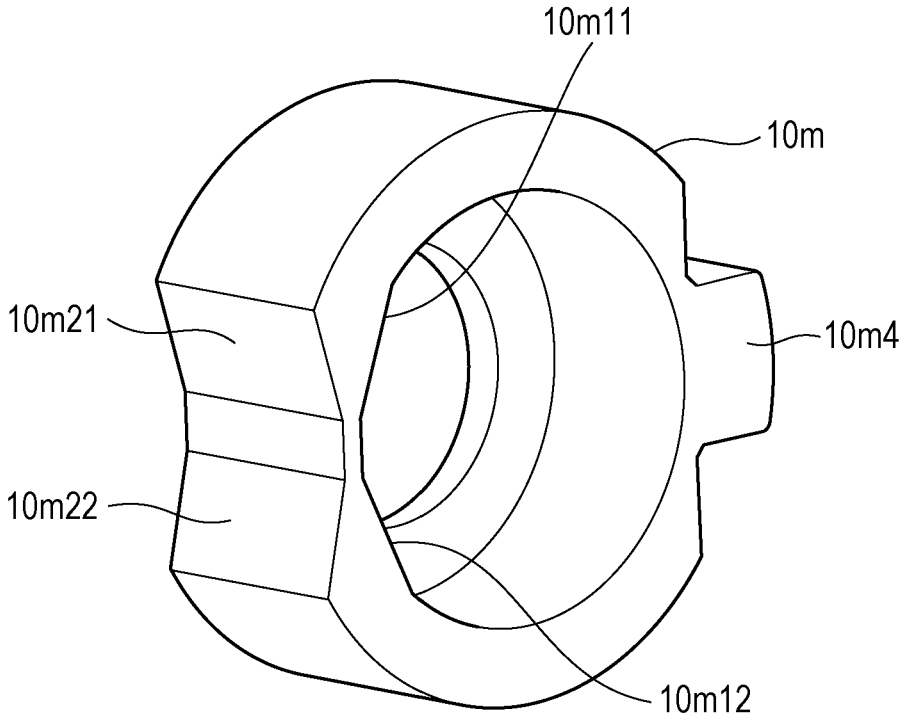
FIG. 15 is an explanatory drawing illustrating a spacer.
Figure 16:
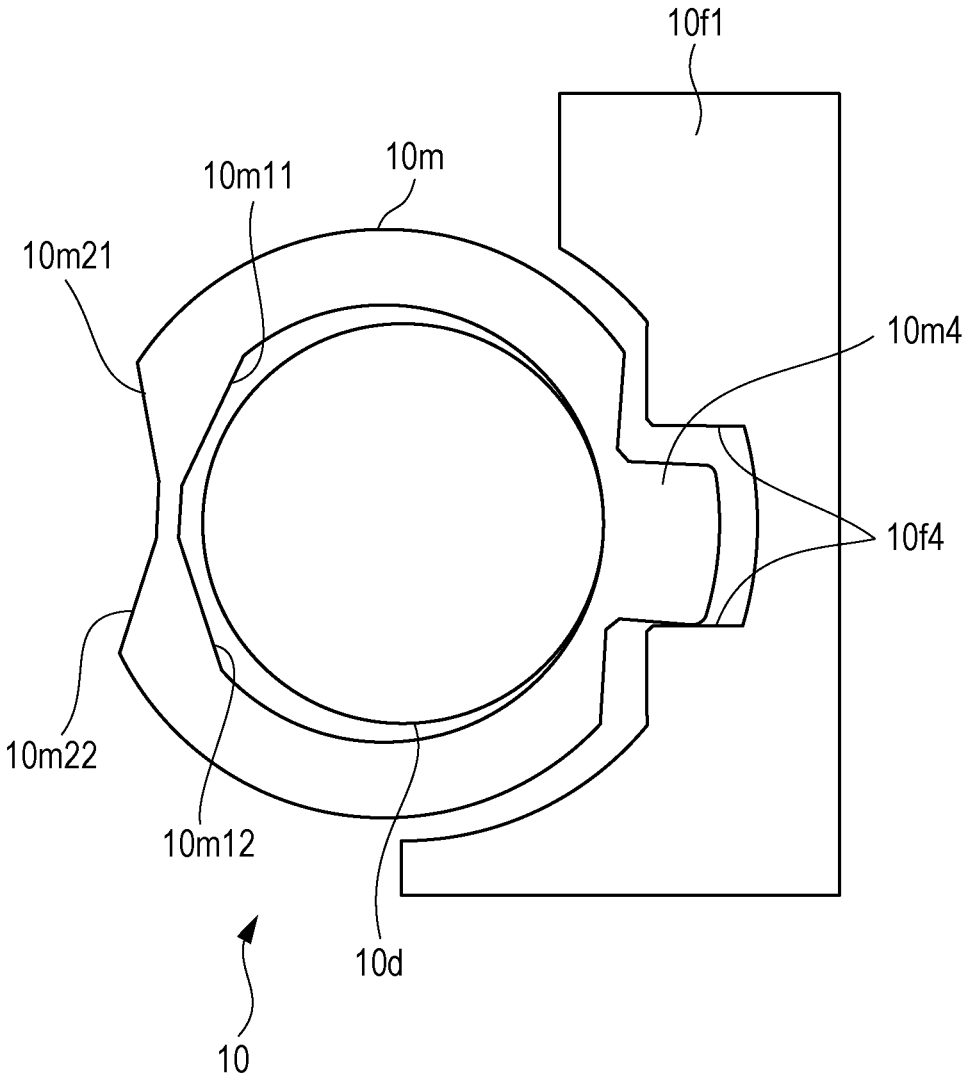
FIG. 16 is an explanatory drawing illustrating a spacer.

As illustrated in FIG. 15 and FIG. 16, a configuration in which a protruding portion (an engaging portion) 10*m*4 may be provided on the spacer 10*m* so as to be positioned within a predetermined range with respect to the developing frame 10*f*1.

As illustrated in FIG. 16, the position of the developing roller 10*d* with respect to the developing frame 10*f*1 is fixed in the developing unit 10. The spacer 10*m* is movable by an amount corresponding to a clearance between an inner peripheral surface of the spacer 10*m* and an outer peripheral surface of the developing roller 10*d*. However, the protruding portion 10*m*4 provided on the spacer 10*m* and a rotation stop portion (depressed portion) 10*f*4 of the developing frame 10*f*1 interfere (come into contact) with each other, so that the spacer 10*m* is configured to be fixed in position within a predetermined range with respect to the developing roller 10*d* within a predetermined rattling range. In other words, by engagement with the developing frame, the protruding portion 10*m*4 prevents the spacer 10*m* from rotating about the developing roller 10*d* beyond the predetermined angle.

Figure 17:
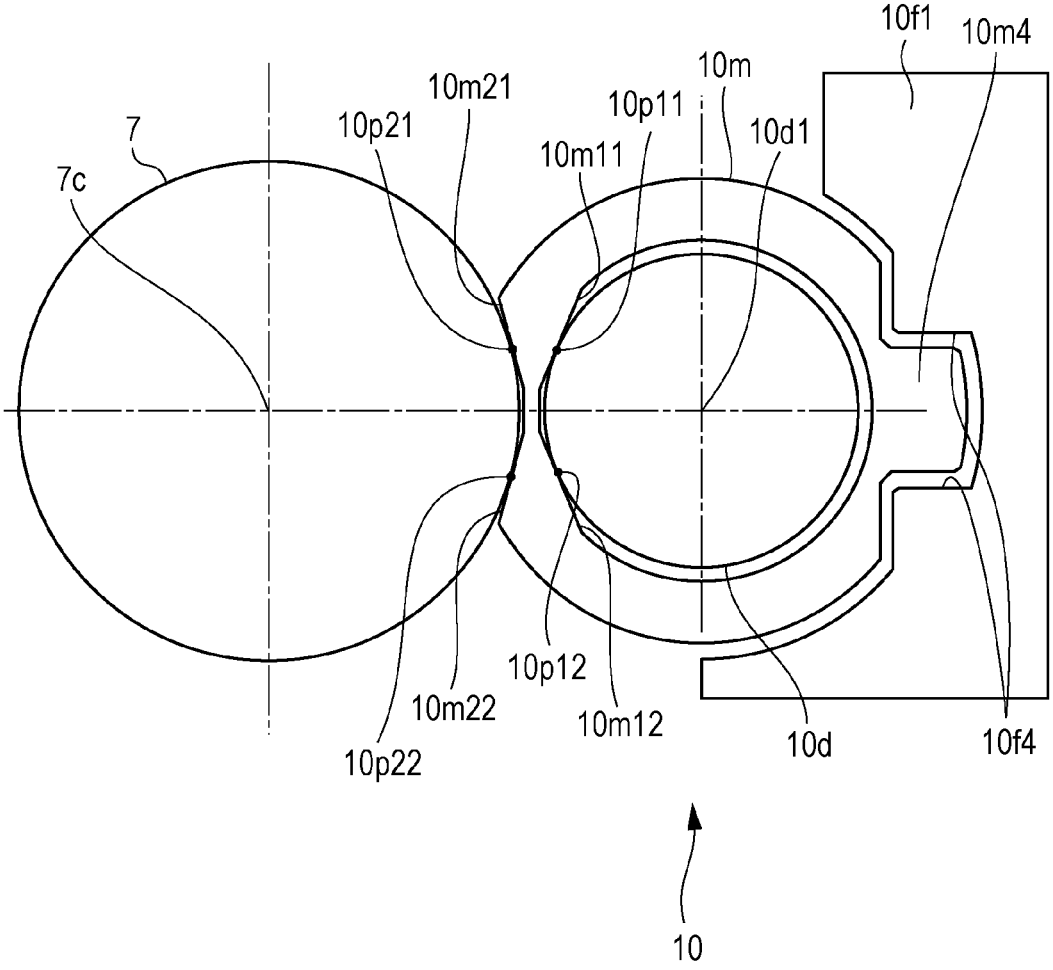
FIG. 17 is an explanatory drawing illustrating a spacer.

In this manner, in a state in which the spacer 10*m* is positioned with respect to the developing roller 10*d* within the predetermined range, the drum unit 11 is assembled to the developing unit 10. With this operation, the photosensitive drum contact surfaces 10*m*21 and 10*m*22 is induced to the surface of the photosensitive drum 7 and the developing roller contact surfaces 10*m*11 and 10*m*12 are induced to the surface of the developing roller 10*d* as illustrated in FIG. 17. The position of the spacer 10*m* is fixed by being held between the photosensitive drum 7 and the developing roller 10*d*.

At this time, the protruding portion 10*m*4 of the spacer 10*m* is configured to have a clearance with respect to the developing frame 10*f*1 so as not to interfere (come into contact) therewith. In other words, in a state in which the process cartridge is assembled, and the spacer 10*m* comes into contact both with the photosensitive drum 7 and the developing roller 10*d* and maintains a constant interval with respect to the photosensitive drum 7 and the developing roller 10*d*, the protruding portion 10*m*4 does not come into contact with the rotation stop portion 10*f*4.

In the configuration described above, the developing unit 10 which allows the drum unit 11 to be assembled simply to the developing unit 10 without aligning the phase of the spacer 10*m* may be provided.

This configuration is also applicable to the separate-type cartridge in which the process cartridge described above includes two cartridges; the drum unit 11 and the developing unit 10. In other words, the "configuration of the process cartridge" does not mean a single process cartridge, and includes a case of being composed of a plurality of cartridges.

Example 3

Figure 5:
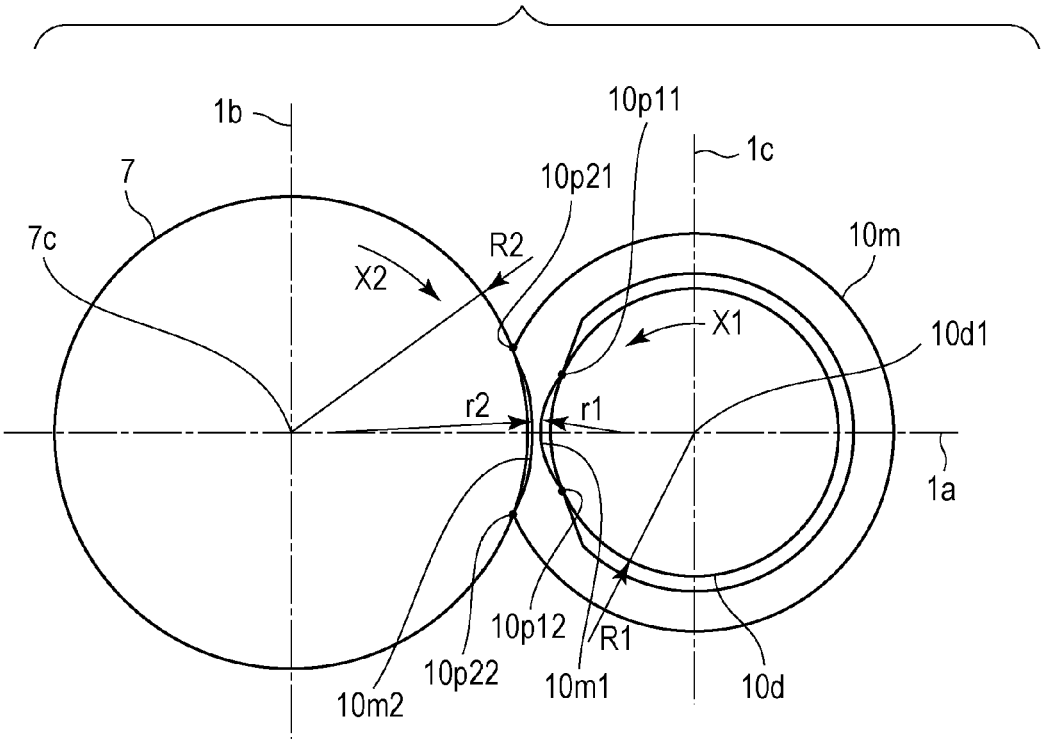
FIG. 5 is an explanatory drawing illustrating a spacer.
Figure 5:
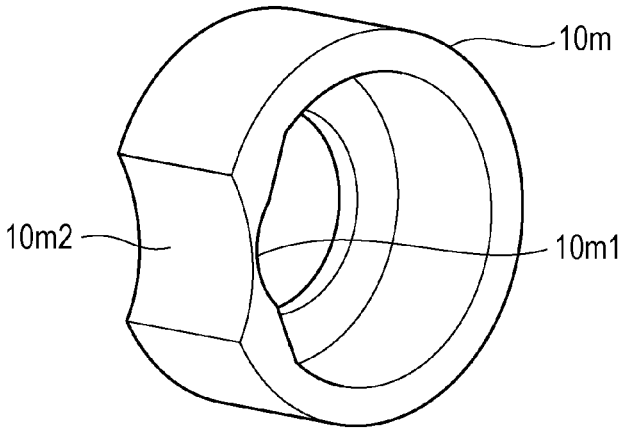

Here, the shape of the spacer 10*m* is not limited to the shape described above. For example, as illustrated in FIG. 5, the arcuate-shaped photosensitive drum contact surface 10*m*2 is provided for the outer peripheral radius R2 of the photosensitive drum 7, and the radius r2 thereof may be set to have a relationship of R2>r2. The spacer 10*m* comes into contact with the surface of the photosensitive drum 7 at the ends of the photosensitive drum contact surface 10*m*2 at the photosensitive drum sliding contact portions 10*p*21 and 10*p*22.

In the same manner, as illustrated in FIG. 5, the arcuate-shaped developing roller contact surface 10*m*1 is provided for the outer peripheral radius R1 of the developing roller 10*d*, and the radius r1 thereof may be set to have a relationship of R1>r1. The spacer 10*m* comes into contact with the surface of the developing roller 10*d* at the ends of the developing roller contact surface 10*m*1 at the developing roller sliding contact portions 10*p*11 and 10*p*12.

Figure 6:
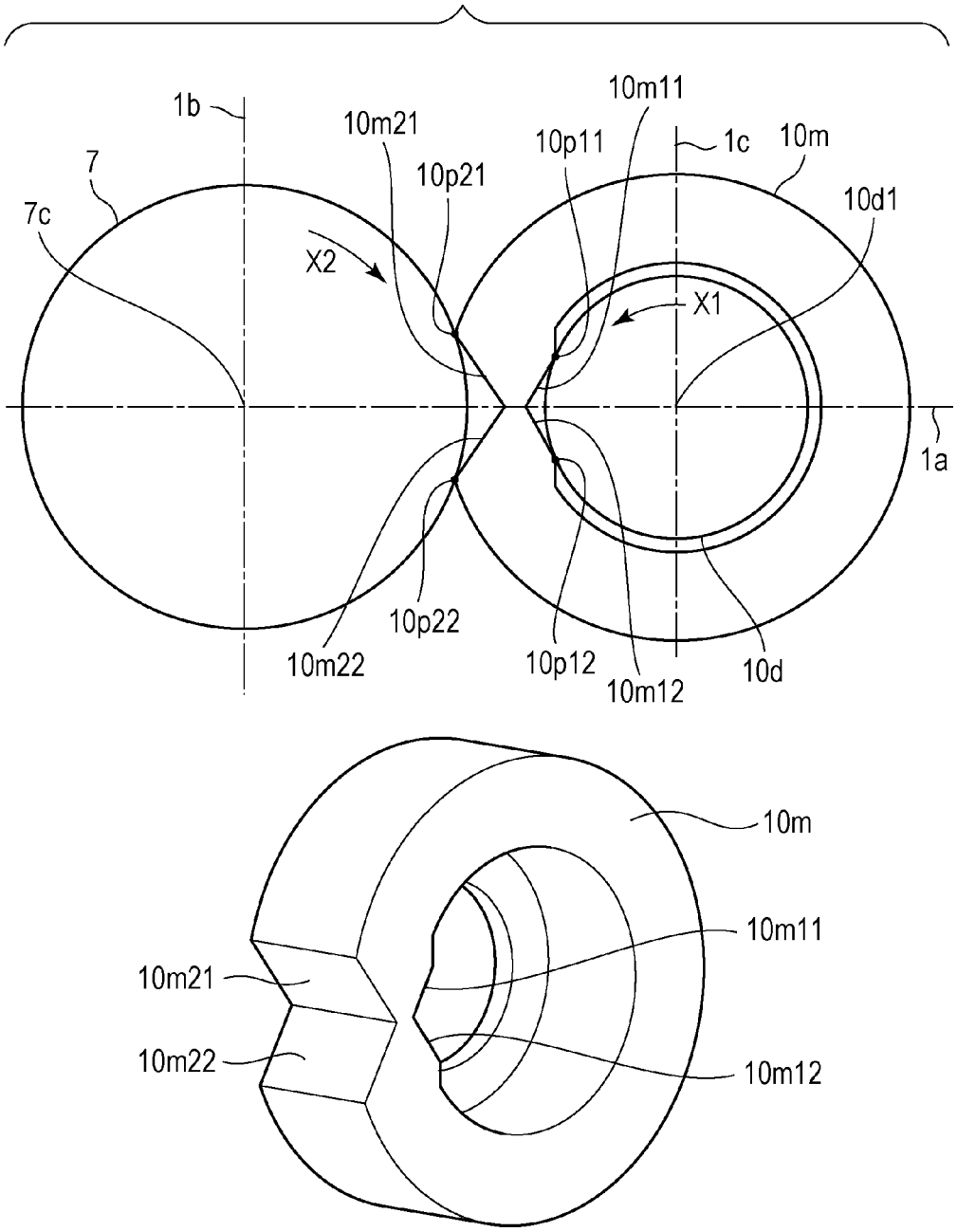
FIG. 6 is an explanatory drawing illustrating a spacer.

The shape of the spacer 10*m* is not limited to the shape illustrated in FIG. 5, and the photosensitive drum sliding contact portions 10*p*21 and 10*p*22 may be configured so as to come into sliding contact with the photosensitive drum 7 at the ends of the photosensitive drum contact surfaces 10*m*21 and 10*m*22 as illustrated in FIG. 6.

In the same manner, as illustrated in FIG. 6, the developing roller sliding contact portions 10*p*11 and 10*p*12 may be configured so as to come into sliding contact with the developing roller 10*d* at the ends of the developing roller contact surfaces 10*m*11 and 10*m*12.

As described above, the spacer 10*m* comes into sliding contact with the developing roller 10*d* and the photosensitive drum 7 at the developing roller sliding contact portions 10*p*11 and 10*p*12 and the photosensitive drum sliding contact portions 10*p*21 and 10*p*22, respectively during the image-forming period. Accordingly, even though the developing roller 10*d* and the photosensitive drum 7 rotate, the spacer 10*m* does not rotate. Accordingly, the spacer 10*m* is capable of maintaining stably the interval between the photosensitive drum 7 and the developing roller 10*d*.

Example 4

Figure 7:
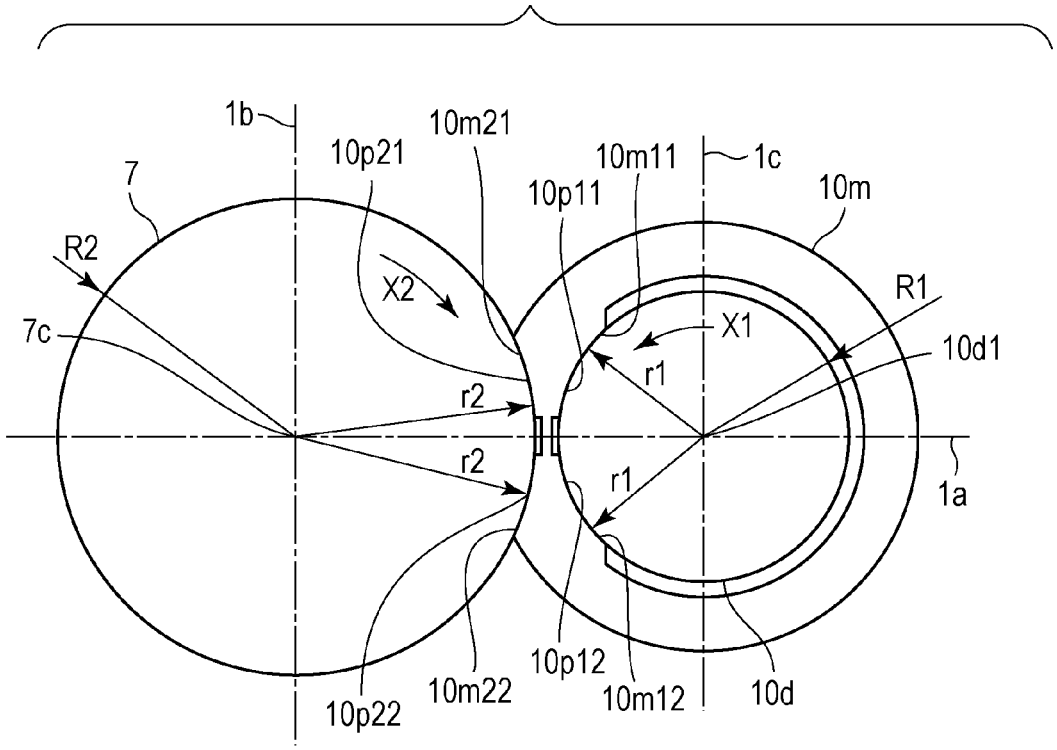
FIG. 7 is an explanatory drawing illustrating a spacer.
Figure 7:
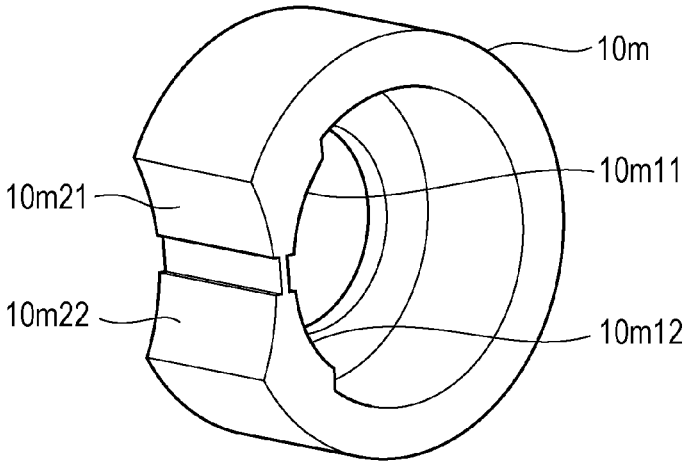

As illustrated in FIG. 7, the radius r2 of the arcuate-shaped photosensitive drum contact surfaces 10*m*21 and 10*m*22 may be set to be substantially the same for the outer peripheral radius R2 of the photosensitive drum 7. The spacer 10*m* of this example comes into sliding contact with the photosensitive drum 7 at the photosensitive drum sliding contact portions 10*p*21 and 10*p*22 having a predetermined surface area.

In the same manner, as illustrated in FIG. 7, the radius r1 of the arcuate-shaped developing roller contact surfaces 10*m*11 and 10*m*12 may be set to be substantially the same as the outer peripheral radius R1 of the developing roller 10*d*. The spacer 10*m* comes into sliding contact with the developing roller 10*d* at the developing roller sliding contact portions 10*p*11 and 10*p*12 having the predetermined surface area.

In this case, the photosensitive drum sliding contact portions 10*p*21 and 10*p*22 desirably occupy the entire areas of the photosensitive drum contact surfaces 10*m*21 and 10*m*22, but may occupy part of them.

In the same manner, the developing roller sliding contact portions 10*p*11 and 10*p*12 desirably occupy the entire areas of the developing roller contact surfaces 10*m*11 and 10*m*12, but may occupy part of them.

In this example, the shape of the photosensitive drum contact surfaces 10*m*21 and 10*m*22 is the arcuate shape. However, a curved surface which follows the peripheral surface of the photosensitive drum 7 is also applicable. In this case as well, the spacer 10*m* may be configured to come into sliding contact with the photosensitive drum 7 at the photosensitive drum sliding contact portions 10*p*21 and 10*p*22 having a predetermined surface area with respect to the photosensitive drum 7.

In the same manner, although the shape of the developing roller contact surfaces 10*m*11 and 10*m*12 is the arcuate shape, a curved surface which follows the peripheral surface of the developing roller 10*d* is also applicable. In this case as well, the spacer 10*m* may be configured to come into sliding contact with the developing roller 10*d* at the developing roller sliding contact portions 10*p*11 and 10*p*12 having a predetermined surface area with respect to the developing roller 10*d*.

With the spacer 10*m* configured as described above, a contact surface area of the photosensitive drum sliding contact portions 10*p*21 and 10*p*22 and a contact surface area of the developing roller sliding contact portions 10*p*11 and 10*p*12 may increase, and the contact pressure that the spacer 10*m* receives from the photosensitive drum 7 and the developing roller 10*d* may be reduced.

In this example, by forming the sliding contact portions into an arcuate shape so as to follow the peripheral surfaces of the photosensitive drum 7 and the developing roller 10*d*, contact of the sliding contact portions of the spacer 10*m* with respect to the photosensitive drum 7 and the developing roller 10*d* is achieved without clearance. In other words, the maximum contact surface area is obtained in the same space, and hence the contact pressure that the spacer 10*m* receives from the photosensitive drum 7 and the developing roller 10*d* may further be reduced.

Accordingly, the amount of scraping of the photosensitive drum sliding contact portions 10*p*21 and 10*p*22 and the developing roller sliding contact portions 10*p*11 and 10*p*12 may be suppressed, and hence the lifetime of the spacer 10*m* may be elongated.

Therefore, according to the configuration described above, even though the developing roller 10*d* and the photosensitive drum 7 rotate, the spacer 10*m* does not rotate, and the interval between the photosensitive drum 7 and the developing roller 10*d* is stably maintained. In addition, the scraping of the photosensitive drum sliding contact portions 10*p*21 and 10*p*22 and the developing roller sliding contact portions 10*p*11 and 10*p*12 is reduced, and hence the interval between the photosensitive drum 7 and the developing roller 10*d* is further maintained stably.

Example 5

Figure 8:
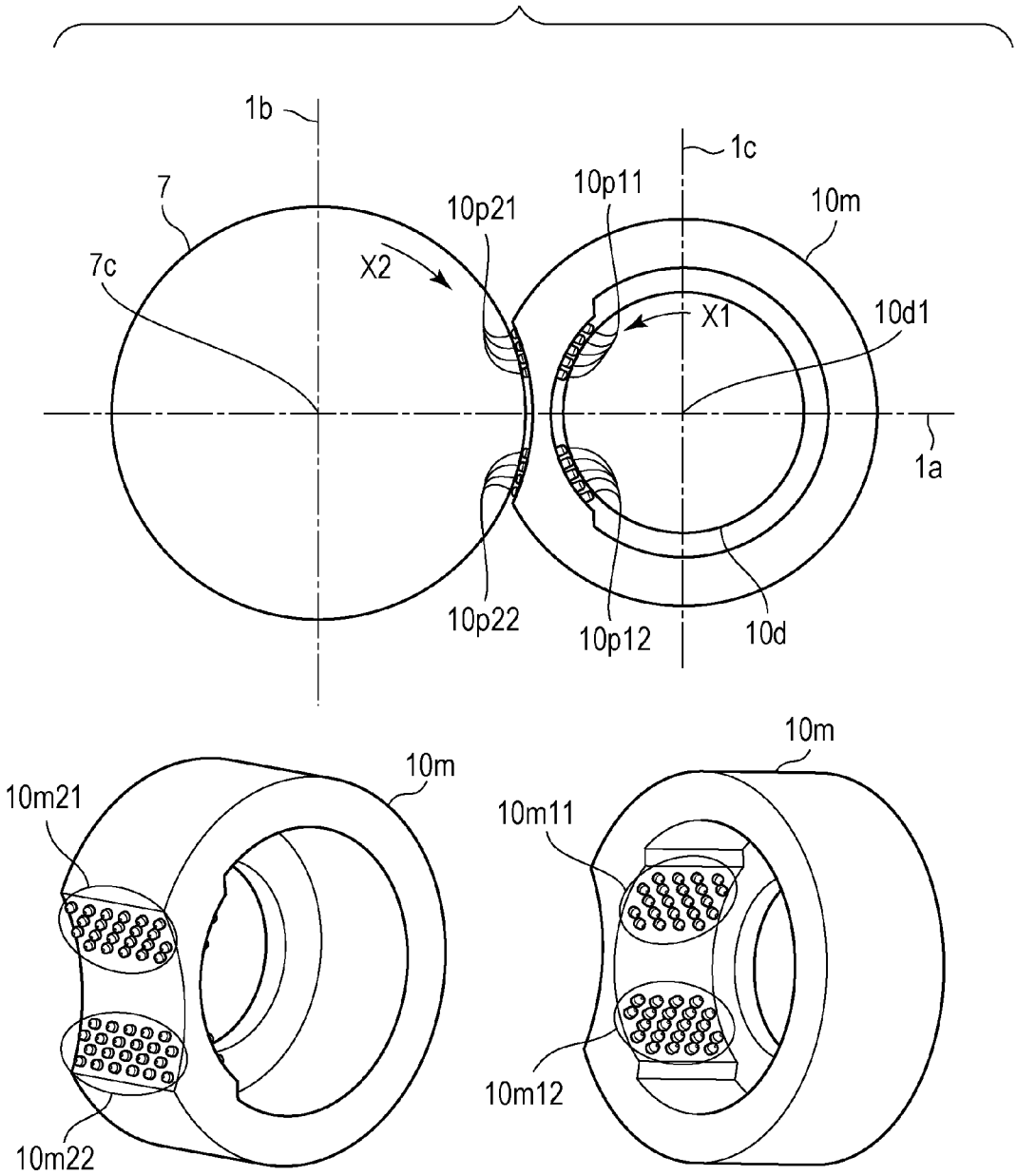
FIG. 8 is an explanatory drawing illustrating a spacer.

As illustrated in FIG. 8, the photosensitive drum contact surfaces 10*m*21 and 10*m*22 of the spacer 10*m* may be formed of a plurality of protrusions arranged so as to follow the peripheral surface of the photosensitive drum 7. In other words, the photosensitive drum sliding contact portions 10*p*21 and 10*p*22 may be configured so as to come into sliding contact with the photosensitive drum 7 at a plurality of points.

In the same manner, as illustrated in FIG. 8, the developing roller sliding contact portions 10*p*11 and 10*p*12 may be configured in such a manner that the developing roller contact surfaces 10*m*11 and 10*m*12 of the spacer 10*m* are formed of a plurality of protrusions that follow the peripheral surface of the developing roller 10*d*, so that sliding contact with the developing roller 10*d* occurs at a plurality of points.

Figure 9:
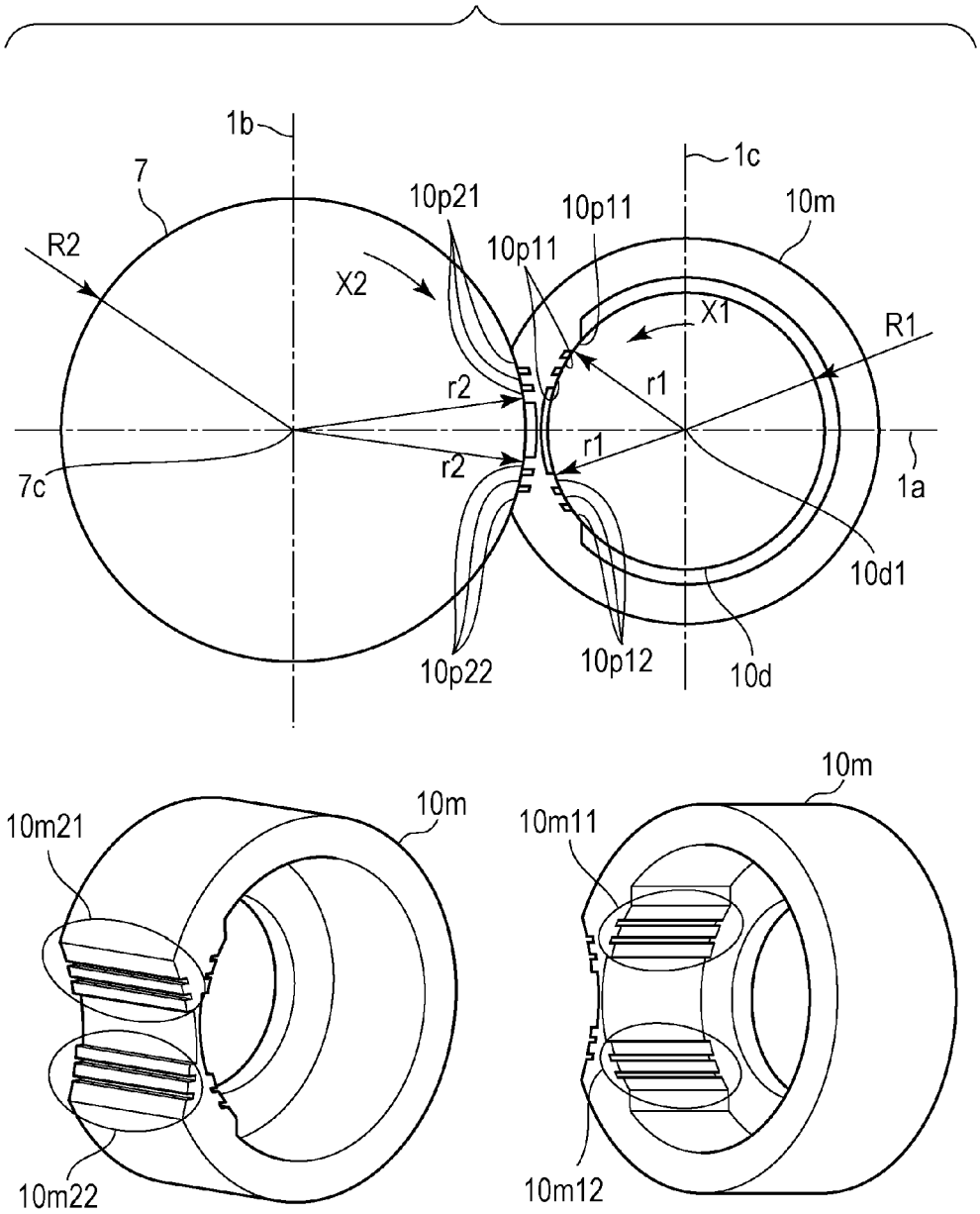
FIG. 9 is an explanatory drawing illustrating a spacer.

The shape of the spacer 10*m* is not limited to the shape illustrated in FIG. 8, and the arcuate-shaped photosensitive drum contact surfaces 10*m*21 and 10*m*22 may be formed of a plurality of surfaces that have a radius r2 substantially the same as the outer peripheral radius R2 of the photosensitive drum 7 as illustrated in FIG. 9.

In the same manner, the arcuate-shaped developing roller contact surfaces 10*m*11 and 10*m*12 may be formed of a plurality of surfaces that have a radius r1 substantially the same as the outer peripheral radius R1 of the developing roller 10*d* as illustrated in FIG. 9.

In FIG. 9, the photosensitive drum contact surface 10*m*21 includes grooves formed therein to be divided into a plurality of surfaces.

As described above, the spacer 10*m* comes into sliding contact with the developing roller 10*d* and the photosensitive drum 7 at the developing roller sliding contact portions 10*p*11 and 10*p*12 and the photosensitive drum sliding contact portions 10*p*21 and 10*p*22, respectively during the image-forming period. Accordingly, even though the developing roller 10*d* and the photosensitive drum 7 rotate, the spacer 10*m* does not rotate. Therefore, the spacer 10*m* is capable of maintaining stably the interval between the photosensitive drum 7 and the developing roller 10*d*.

Example 6

Subsequently, Example 6 will be described. Description of the same configuration as that of the examples described above will be omitted.

Figure 10:
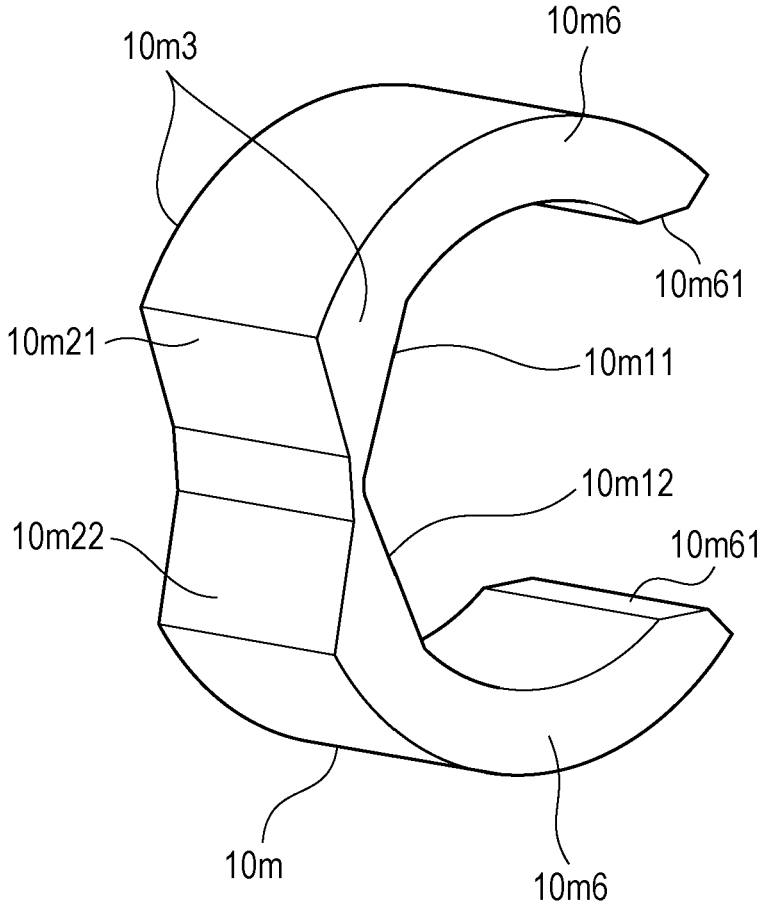
FIG. 10 is an explanatory drawing illustrating a spacer.
Figure 14:
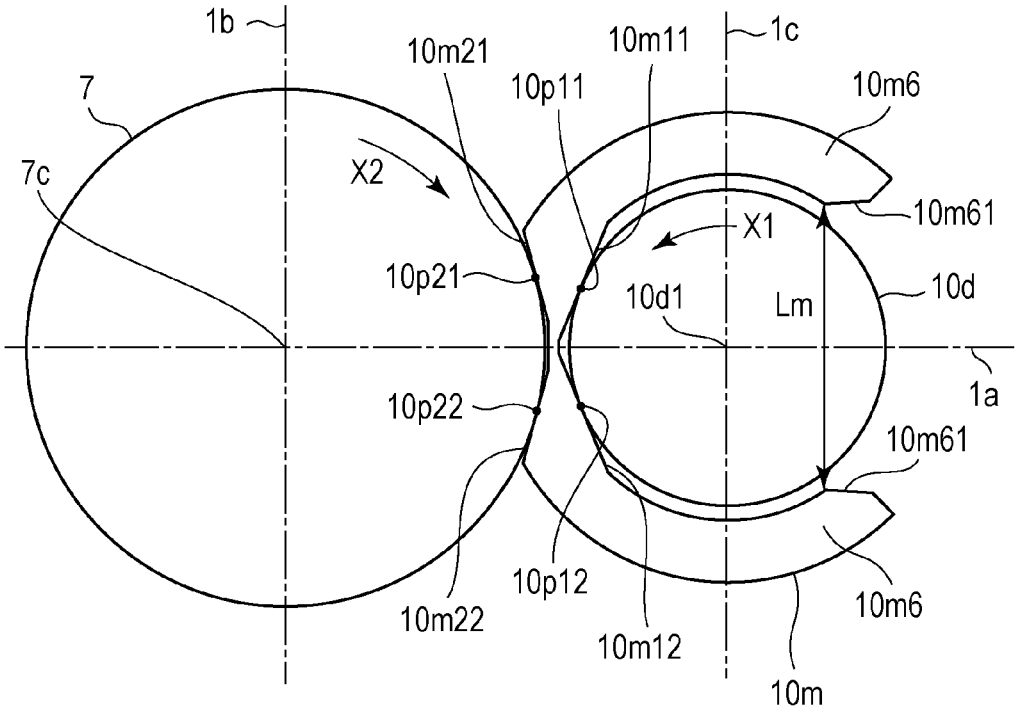
FIG. 14 is an explanatory drawing illustrating a spacer.

The spacer 10*m* is provided with arm portions 10*m*6 extending from the developing roller contact surfaces 10*m*11 and 10*m*12 along the peripheral surface of the developing roller 10*d* toward the upstream and downstream sides in the direction of rotation X1 of the developing 10*d* as illustrated in FIG. 10 and FIG. 14.

The arm portions 10*m*6 of the spacer 10*m* have flexibility, and the spacer 10*m* including the arm portions 10*m*6 covers the developing roller 10*d* over half a circumference thereof or more in the direction of rotation X1 of the developing roller 10*d* as illustrated in FIG. 14. A clearance (an opening portion) is provided between the end portions of the arm portions 10*m*6. The minimum distance (width) Lm of this clearance is configured to be smaller than a diameter of the developing roller 10*d*, 2×R1, in a state in which an external force is not applied to the spacer 10*m*.

Method of Mounting Spacer on Developing Roller

Subsequently, a method of mounting the spacer 10*m* on the developing roller 10*d* will be described in detail with reference to FIG. 10 to FIG. 14.

Figure 11:
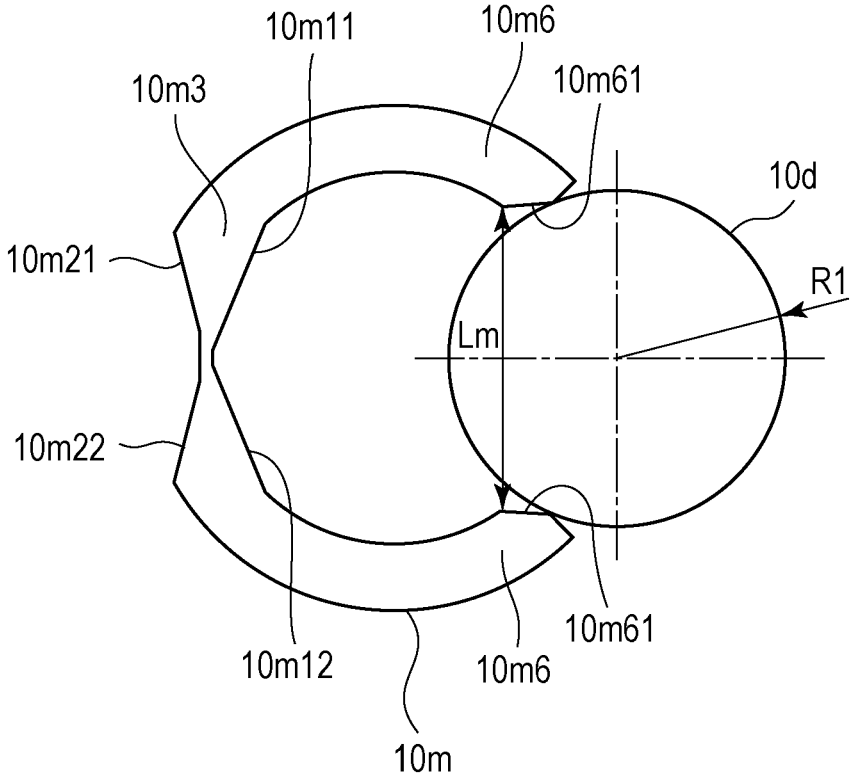
FIG. 11 is an explanatory drawing illustrating a method of assembling the spacer.

When mounting the spacer 10*m* on the developing roller 10*d*, the short side end surfaces 10*m*3 of the spacer 10*m* illustrated in FIG. 10 in the vicinity of the developing roller contact surface 10*m*11 thereof is held, and the both end portions of the arm portions 10*m*6 of the spacer 10*m* are pressed against the surface of the developing roller 10*d* as illustrated in FIG. 11.

A chamfer 10*m*61 is provided at each of the end portions of the arm portions 10*m*6 of the spacer 10*m*, and the distance Lm between the chamfers 10*m*61 is smaller than the diameter of the developing roller 10*d*, 2×R1. Therefore, the chamfers 10*m*61 of the arm portions 10*m*6 of the spacer 10*m* interfere with the surface of the developing roller 10*d*.

Figure 12:
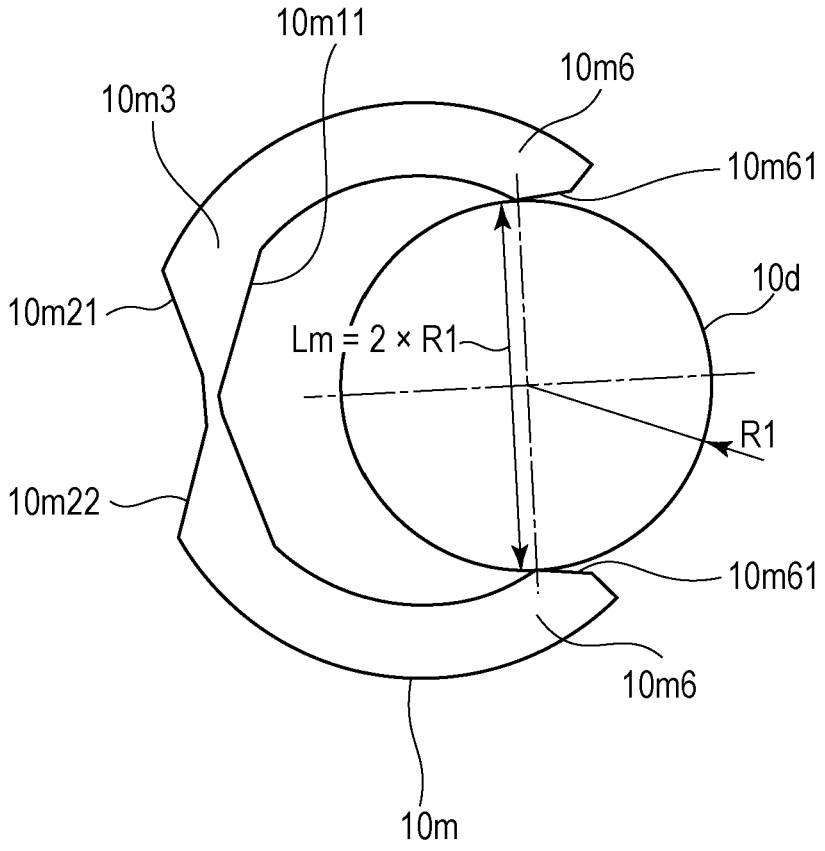
FIG. 12 is an explanatory drawing illustrating the method of assembling the spacer.

Subsequently, when the spacer 10*m* is pressed against the developing roller 10*d*, the spacer 10*m* is deflected in a range of resiliency thereof along the chamfers 10*m*61 at the both end portions of the arm portions 10*m*6 of the spacer 10*m*. As illustrated in FIG. 12, the spacer 10*m* is deformed until the distance Lm becomes equal to the diameter of the developing roller 10*d*, 2×R1.

Figure 13:
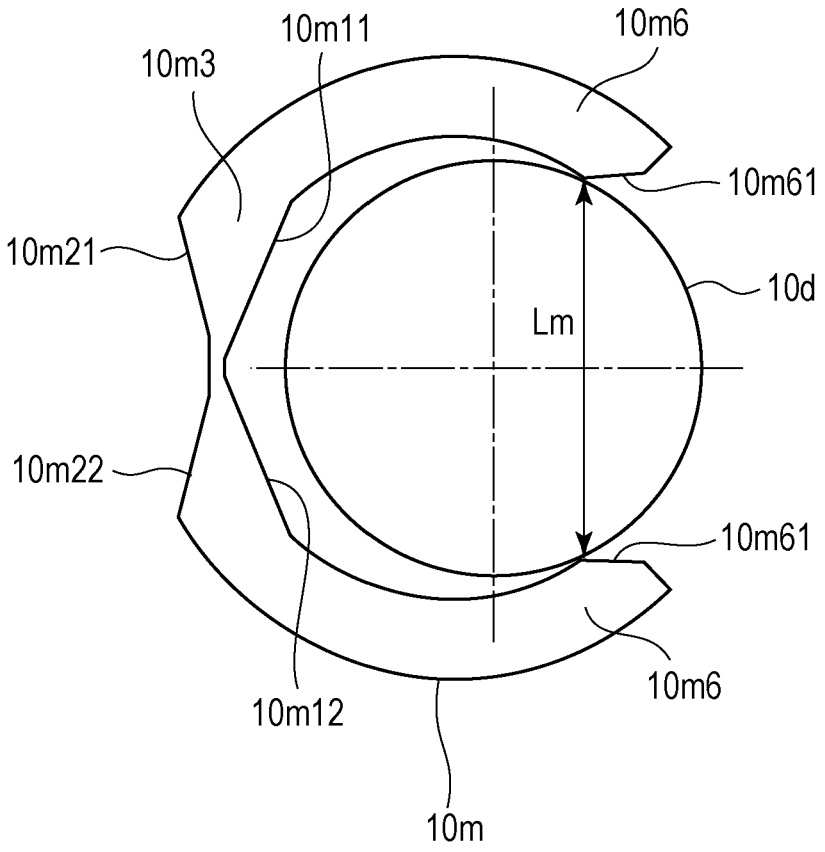
FIG. 13 is an explanatory drawing illustrating the method of assembling the spacer.

Then, by pressing the spacer 10*m* further against the developing roller 10*d*, deformation of the spacer 10*m* is disappeared as illustrated in FIG. 13. The spacer 10*m* is mounted on the surface of the developing roller 10*d*, and the distance Lm between the chamfers 10*m*61 of the arm portions 10*m*6 becomes smaller than the diameter of the developing roller 10*d*, 2×R1.

Here, the distance Lm between the chamfers 10*m*61 of the arm portions 10*m*6 of the spacer 10*m* is smaller than the diameter of the developing roller 10*d*, 2×R1. Therefore, the spacer 10*m* does not drop off the developing roller 10*d* unless the spacer 10*m* mounted on the developing roller 10*d* is pulled by an external force as large as being capable of deforming the spacer 10*m*.

A process of mounting the spacer 10*m* to the developing roller 10*d* may be selectively performed either before or after the developing roller 10*d* is assembled to the developing unit 10.

The developing roller 10*d*, then, is urged in a direction approaching the photosensitive drum 7 by a predetermined pressure f. Consequently, as illustrated in FIG. 14, the spacer 10*m* comes into contact with the photosensitive drum 7 and the developing roller 10*d* respectively at the photosensitive drum sliding contact portions 10*p*21 and 10*p*22 and the developing roller sliding contact portions 10*p*11 and 10*p*12, so that the position of the spacer 10*m* is determined.

At this time, the inner peripheral surfaces of the arm portions 10*m*6 of the spacer 10*m* are provided so as to have a clearance with respect to the surface of the developing roller 10*d*, and hence the arm portions 10*m*6 of the spacer 10*m* do not come into contact with the surface of the developing roller 10*d*.

Method of Demounting Spacer

Subsequently, a method of replacing the spacer 10*m* will be described.

In a state of the developing unit 10, the short side end surfaces 10*m*3 in the vicinity of the developing roller contact surface 10*m*11 of the spacer 10*m* illustrated in FIG. 10 are held, and the spacer 10*m* is pulled by an external force that can deform the arm portions 10*m*6 in the direction away from the developing roller 10*d*. With this operation, the spacer 10*m* may be removed from the developing roller 10*d*.

Then, the spacer 10*m* may be replaced by mounting a new spacer 10*m* on the developing roller 10*d* integrated in the developing unit 10 by using the method of mounting the spacer 10*m* on the developing roller 10*d* as described above.

Since the interval between the developing roller 10*d* and the photosensitive drum 7 is maintained in a state in which the predetermined pressure f is applied to the spacer 10*m*, the spacer 10*m* is worn with increase in number of rotations of the developing roller 10*d* and the photosensitive drum 7 during the image forming period.

Therefore, at the time of maintenance in, for example, recycling of the developing unit 10, if the spacer 10*m* needs to be replaced, demounting and assembling may be achieved independently without demounting other components from the developing unit 10, so that replacement is easy according to the present disclosure.

In this manner, by providing the spacer 10*m* with the flexible arm portions 10*m*6, the spacer 10*m* may be replaced easily from the developing unit 10 without demounting and mounting other components of the developing unit 10.

In the embodiments described above, the example in which the shape of the contact surfaces of the spacer 10*m* with respect to the photosensitive drum 7 and the developing roller 10*d* in the circumferential direction are flat surfaces has been described. However, this disclosure is not limited thereto. For example, the shape of the contact surfaces of the spacer 10*m* with respect to the photosensitive drum 7 and the developing roller 10*d* in the circumferential direction may be curved shapes extending along the circumferential direction of the photosensitive drum 7 and the developing roller 10*d*.

The shape of the arm portions 10*m*6 of the spacer 10*m* is also not limited to the shape illustrated in FIG. 10. The spacer 10*m* including the arm portions 10*m*6 is set to cover half the circumference of the developing roller 10*d* or more and the distance Lm between the end portions of the arm portions 10*m*6 is set to be smaller than the diameter of the developing roller 10*d*. In addition, a condition that the deflection of the arm portions 10*m*6 when mounting the spacer 10*m* on the developing roller 10*d* falls within the range of resilient deformation only needs to be satisfied.

Example 7

Figure 18A:
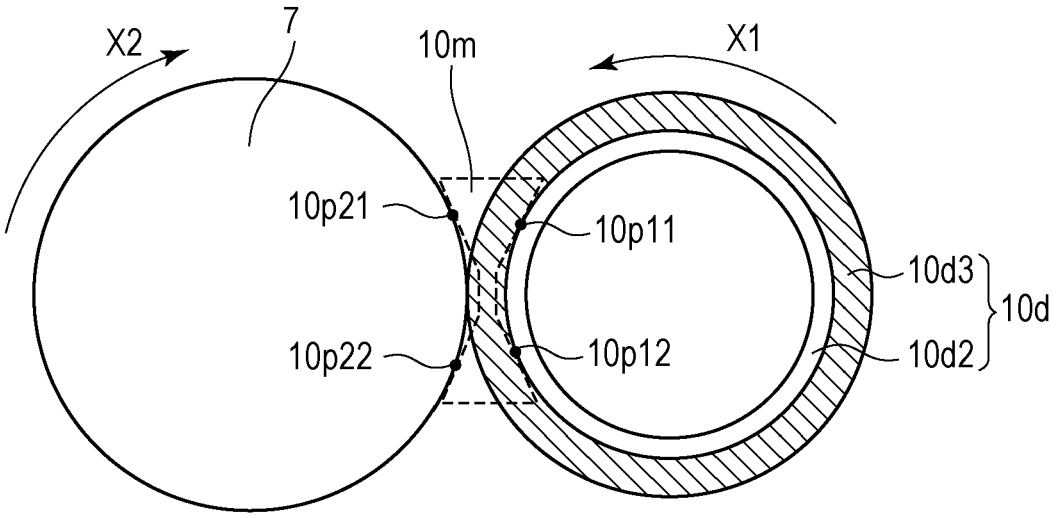
FIG. 18A is a schematic diagram illustrating cross sections of an image developing roller and a photosensitive drum.
Figure 18B:
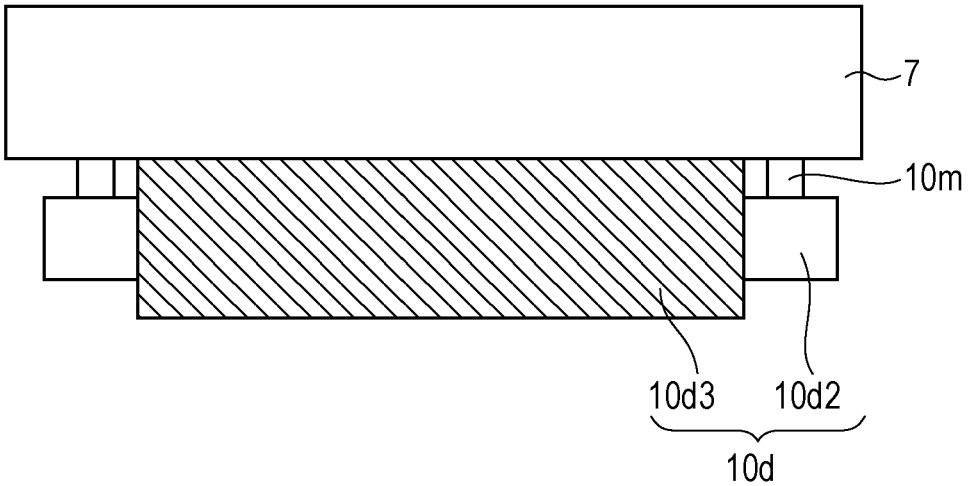
FIG. 18B is an explanatory drawing illustrating an arrangement of the spacer.

In Example 1 described above, the image forming apparatus of the noncontact developing system in which the spacer 10*m* maintains a minute space between the surface of the developing roller 10*d* and the surface of the photosensitive drum 7 has been described. In contrast, in this example, a configuration will be described in which the spacer 10*m* is used in a contact developing system where the surface of the developing roller 10*d* and the surface of the photosensitive drum 7 come partly into contact with each other. FIG. 18A is a schematic diagram illustrating cross sections of the developing roller 10*d* and the photosensitive drum 7 in this example. FIG. 18B is an explanatory drawing illustrating an arrangement of the spacer 10*m* in this example.

In this example as illustrated in FIG. 18A, the developing roller 10*d* has a configuration being covered by a rubber tube (a resilient portion) 10*d*3 having resiliency over an outer periphery of a cylindrical aluminum tube 10*d*2. In this example, the distance between the surfaces of the developing roller 10*d* and the photosensitive drum 7 at the nearest position becomes zero. In other words, in the nearest position, the rubber tube 10*d*3 of the developing roller 10*d* comes into contact with the photosensitive drum 7. The spacer 10*m* comes into contact with the aluminum tube 10*d*2 at two points, and comes into contact with the photosensitive drum 7 also at two points. In other words, the spacer 10*m* of this example includes the first and the second developing roller sliding contact portions 10*p*11 and 10*p*12, and the first and the second photosensitive drum sliding contact portions 10*p*21 and 10*p*22 in the same manner as the above-described example. Accordingly, the distance between the developing roller 10*d* and the photosensitive drum 7 (the distance between the centers of the both) is maintained constant.

Although the rubber tube 10*d*3 of the developing roller 10*d* is compressed by coming into contact with the photosensitive drum 7, the amount of compression is maintained constant by the spacer 10*m*. Since the rubber tube 10*d*3 keeps in contact with the photosensitive drum 7 with a constant pressure, the developing roller 10*d* can continuously form toner images (developer images) having a constant quality on the photosensitive drum 7.

Summary of Advantages of Respective Examples

In conclusion, summary of the common advantages of the examples described thus far will be described below. According to the configuration of the examples described in this application, even if the developer bearing member and the image bearing member rotate during an image-forming period, movement of the interval securing member in the direction of rotations is prevented. Therefore, the interval securing member maintains the distance between the developer bearing member and the image bearing member stably.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An interval securing member configured to maintain a distance between an image bearing member and a roller, the image bearing member being provided rotatably and configured so that a latent image is formed thereon, comprising:

a first image bearing member side sliding contact portion configured to come into sliding contact with the image bearing member on an upstream side in a direction of rotation of the image bearing member from a nearest position where the distance between the image bearing member and the roller becomes the smallest;

a first roller side sliding contact portion configured to come into sliding contact with the roller on an upstream side from the nearest position in a direction of rotation of the roller;

a second image bearing member side sliding contact portion configured to come into sliding contact with the image bearing member on a downstream side from the nearest position in the direction of rotation of the image bearing member; and a second roller side sliding contact portion configured to come into sliding contact with the roller on a downstream side from the nearest position in the direction of rotation of the roller, wherein the first image bearing member side sliding contact portion and the first roller side sliding contact portion come into abutment with the image bearing member and the roller respectively, so that the interval securing member is prevented from moving in the direction of rotations of the image bearing member and the roller when the image bearing member and the roller rotate, wherein the interval securing member does not come into contact with the image bearing member and the roller on a straight line connecting a center of the image bearing member and a center of the roller.

2. The interval securing member according to claim 1, wherein the roller is a developer bearing member which bears developer for developing the latent image.

3. The interval securing member according to claim 1, wherein the first and second developer side sliding contact portions come into contact with the roller outside of a region in which developer is borne by the roller in an axial direction of the roller.

4. The interval securing member according to claim 1, wherein the interval securing member has a ring shape and is mounted on an outer periphery of the roller.

5. The interval securing member according to claim 1, wherein the interval securing member includes an opening portion for mounting the interval securing member on the roller and is capable of covering half a circumference of the roller or more when being mounted on the roller, the width of the opening portion is smaller than the diameter of the roller in a state in which no force is applied to the interval securing member, and is allowed to be increased to the width which is the same as the diameter of the roller by deformation of the interval securing member.

6. The interval securing member according to claim 1, wherein at least one of the first and the second image baring member side sliding contact portions and the first and the second roller side sliding contact portions has a curved surface following a peripheral surface of the image bearing member or a peripheral surface of the roller.

7. The interval securing member according to claim 1, wherein at least one of the first and the second image baring member side sliding contact portions and the first and the second roller side sliding contact portions has an arcuate shape.

8. The interval securing member according to claim 1, wherein at least one of the first and the second image baring member side sliding contact portions and the first and the second roller side sliding contact portions is formed of a plurality of protrusions.

9. The interval securing member according to claim 1, wherein at least one of the first and the second image baring member side sliding contact portions and the first and the second roller side sliding contact portions is formed of a plurality of divided surfaces.

10. The interval securing member according to claim 1, wherein the interval securing member is mounted on the roller, the interval securing member includes an engaging portion; and the engaging portion prevents the interval securing member from rotating beyond a predetermined angle around the roller by being engaged with a developing frame that supports the roller.

11. The interval securing member according to claim 1, wherein the interval securing member maintains the distance between the roller and the image bearing member in a state in which the surface of the roller and the surface of the image bearing member are apart from each other.

12. The interval securing member according to claim 1, wherein the distance between the roller and the image bearing member is maintained in a state in which the surface of the roller and the surface of the image bearing member are in contact with each other.

13. The interval securing member according to claim 12, wherein a resilient portion is provided on the surface of the roller, and the resilient portion comes into contact with the surface of the image bearing member.

14. A developing apparatus used in an image forming apparatus, comprising:

a developer bearing member configured to bear developer; and an interval securing member configured to maintain the distance between the image bearing member and the developer bearing member, wherein the interval securing member includes:

a first image bearing member side sliding contact portion configured to come into sliding contact with the image bearing member on an upstream side in a direction of rotation of the image bearing member from a nearest position where the distance between the image bearing member and the developer bearing member becomes the smallest;

a first developing side sliding contact portion configured to come into sliding contact with the developer bearing member on an upstream side from the nearest position in a direction of rotation of the developer bearing member;

a second image bearing member side sliding contact portion configured to come into sliding contact with the image bearing member on a downstream side from the nearest position in the direction of rotation of the image bearing member; and a second developing side sliding contact portion configured to come into sliding contact with the developer bearing member on a downstream side from the nearest position in the direction of rotation of the developer bearing member, and wherein the first image bearing member side sliding contact portion and the first developing side sliding contact portion come into abutment with the image bearing member and the developer bearing member respectively, so that the interval securing member is prevented from moving in the direction of rotations of the image bearing member and the developer bearing member when the image bearing member and the developer bearing member rotate, wherein the interval securing member does not come into contact with the image bearing member and the developer bearing member on a straight line connecting a center of the image bearing member and a center of the developer bearing member.

15. The developing apparatus according to claim 14, wherein the first and the second developer side sliding contact portions come into contact with the developer bearing member outside of a region in which developer is borne by the developer bearing member in an axial direction of the developer bearing member.

16. The developing apparatus according to claim 14, wherein the interval securing member has a ring shape and is mounted on an outer periphery of the developer bearing member.

17. The developing apparatus according to claim 14, wherein the interval securing member includes an opening portion for mounting the interval securing member on the developer bearing member and is capable of covering half a circumference of the developer bearing member or more when being mounted on the developer bearing member, and the width of the opening portion is smaller than the diameter of the developer bearing member in a state in which no force is applied to the interval securing member, and is allowed to be increased to the width which is the same as the diameter of the developer bearing member by deformation of the interval securing member.

18. The developing apparatus according to claim 14, wherein at least one of the first and the second image baring member side sliding contact portions and the first and the second developing side sliding contact portions has a curved surface following a peripheral surface of the image bearing member or a peripheral surface of the developer bearing member.

19. The developing apparatus according to claim 14, wherein at least one of the first and the second image baring member side sliding contact portions and the first and the second developing side sliding contact portions has an arcuate shape.

20. The developing apparatus according to claim 14, wherein at least one of the first and the second image baring member side sliding contact portions and the first and the second developing side sliding contact portions is formed of a plurality of protrusions.

21. The developing apparatus according to claim 14, wherein at least one of the first and the second image baring member side sliding contact portions and the first and the second developing side sliding contact portions is formed of a plurality of divided surfaces.

22. The developing apparatus according to claim 14, wherein the interval securing member is mounted on the developer bearing member, the interval securing member includes an engaging portion; and the engaging portion prevents the interval securing member from rotating beyond a predetermined angle around the developer bearing member by being engaged with a developing frame that supports the developer bearing member.

23. The developing apparatus according to claim 14, wherein the interval securing member maintains the distance between the developer bearing member and the image bearing member in a state in which the surface of the developer bearing member and the surface of the image bearing member are apart from each other.

24. The developing apparatus according to claim 14, wherein the interval securing member maintains the distance between the developer bearing member and the image bearing member in a state in which the surface of the developer bearing member and the surface of the image bearing member are in contact with each other.

25. The developing apparatus according to claim 24, wherein a resilient portion is provided on the surface of the developer bearing member, and the resilient portion comes into contact with the surface of the image bearing member.

26. The developing apparatus according to claim 14, wherein the developing apparatus is detachably attachable to a main body of the image forming apparatus.

27. A process cartridge configured to be detachably attachable to a main body of an image forming apparatus comprising:

an image bearing member provided rotatably and configured so that a latent image is formed thereon, a roller, and an interval securing member configured to maintain the distance between the image bearing member and the roller, wherein the interval securing member includes:

a first image bearing member side sliding contact portion configured to come into sliding contact with the image bearing member on an upstream side in a direction of rotation of the image bearing member from a nearest position where the distance between the image bearing member and the roller becomes the smallest;

a first roller side sliding contact portion configured to come into sliding contact with the roller on an upstream side from the nearest position in a direction of rotation of the roller;

a second image bearing member side sliding contact portion configured to come into sliding contact with the image bearing member on a downstream side from the nearest position in the direction of rotation of the image bearing member; and a second roller side sliding contact portion configured to come into sliding contact with the roller on a downstream side from the nearest position in the direction of rotation of the roller, and wherein the first image bearing member side sliding contact portion and the first roller side sliding contact portion come into abutment with the image bearing member and the roller respectively, so that the interval securing member is prevented from moving in the direction of rotations of the image bearing member and the roller when the image bearing member and the roller rotate, wherein the interval securing member does not come into contact with the image bearing member and the roller on a straight line connecting a center of the image bearing member and a center of the roller.

28. The process cartridge according to claim 27, wherein the roller is a developer bearing member which bears developer for developing the latent image.

29. The process cartridge according to claim 27, wherein the first and the second developer side sliding contact portions come into contact with the roller outside of a region in which a developer is borne by the roller in an axial direction of the roller.

30. The process cartridge according to claim 27, wherein the interval securing member has a ring shape and is mounted on an outer periphery of the roller.

31. The process cartridge according to claim 27, wherein the interval securing member includes an opening portion for mounting the interval securing member on the roller and is capable of covering half a circumference of the roller or more when being mounted on the roller, and the width of the opening portion is smaller than the diameter of the roller in a state in which no force is applied to the interval securing member, and is allowed to be increased to the width which is the same as the diameter of the roller by deformation of the interval securing member.

32. The process cartridge according to claim 27, wherein at least one of the first and the second image baring member side sliding contact portions and the first and the second roller side sliding contact portions has a curved surface following a peripheral surface of the image bearing member or a peripheral surface of the roller.

33. The process cartridge according to claim 27, wherein at least one of the first and the second image baring member side sliding contact portions and the first and the second roller side sliding contact portions has an arcuate shape.

34. The process cartridge according to claim 27, wherein at least one of the first and the second image baring member side sliding contact portions and the first and the second roller side sliding contact portions is formed of a plurality of protrusions.

35. The process cartridge according to claim 27, wherein at least one of the first and the second image baring member side sliding contact portions and the first and the second roller side sliding contact portions is formed of a plurality of divided surfaces.

36. The process cartridge according to claim 27, wherein the interval securing member is mounted on the roller, the interval securing member includes an engaging portion; and the engaging portion prevents the interval securing member from rotating beyond a predetermined angle around the roller by being engaged with a developing frame that supports the roller.

37. The process cartridge according to claim 27, wherein the interval securing member maintains the distance between the roller and the image bearing member in a state in which the surface of the roller and the surface of the image bearing member are apart from each other.

38. The process cartridge according to claim 27, wherein the interval securing member maintains the distance between the roller and the image bearing member in a state in which the surface of the roller and the surface of the image bearing member are in contact with each other.

39. The process cartridge according to claim 38, wherein a resilient portion is provided on the surface of the roller, and the resilient portion comes into contact with the surface of the image bearing member.

* * * * *